US008499956B2

(12) United States Patent
Westrate et al.

(10) Patent No.: US 8,499,956 B2
(45) Date of Patent: Aug. 6, 2013

(54) CELLULAR CONTAINER

(75) Inventors: Colton Westrate, Zeeland, MI (US); Calvin Kortman, Holland, MI (US); Jim Piesko, Holland, MI (US)

(73) Assignee: ITB Packaging LLC, Holland, MI (US)

( * ) Notice: Subject to any disclaimer, the term of this patent is extended or adjusted under 35 U.S.C. 154(b) by 919 days.

(21) Appl. No.: 12/121,299

(22) Filed: May 15, 2008

(65) Prior Publication Data

US 2008/0283535 A1 Nov. 20, 2008

Related U.S. Application Data

(60) Provisional application No. 60/938,045, filed on May 15, 2007.

(51) Int. Cl.
*B65D 8/14* (2006.01)

(52) U.S. Cl.
USPC ..... 220/6; 220/500; 220/507; 220/520; 220/527; 220/528; 220/529; 220/666; 229/120.02; 229/117.01; 229/120.31; 493/90; 493/91; 493/150

(58) Field of Classification Search
USPC ..... 220/6, 529, 500, 507, 520, 527, 528, 220/666; 229/120.31, 117.01, 120.02; 493/91, 493/90, 150
See application file for complete search history.

(56) References Cited

U.S. PATENT DOCUMENTS

| | | | | |
|---|---|---|---|---|
| 145,137 | A | | 12/1873 | Wade |
| 380,960 | A | | 4/1888 | Walker |
| 657,285 | A | | 9/1900 | Hansell |
| 930,835 | A | | 8/1909 | Brown |
| 1,023,989 | A | | 4/1912 | Brown |
| 2,013,240 | A | | 9/1935 | Harvey |
| 2,063,720 | A | * | 12/1936 | Blau ..... 229/120.31 |
| 2,296,126 | A | * | 9/1942 | Ullrich ..... 229/117 |
| 2,494,437 | A | | 1/1950 | George et al. |
| 2,549,799 | A | | 4/1951 | George |
| 2,549,800 | A | | 4/1951 | George |
| 2,549,801 | A | | 4/1951 | George |
| 2,979,246 | A | | 4/1961 | Liebeskind |

(Continued)

FOREIGN PATENT DOCUMENTS

| | | |
|---|---|---|
| JP | 51-111424 U | 9/1976 |
| JP | 52-030368 U | 3/1977 |

(Continued)

OTHER PUBLICATIONS

Takahiro Tanegashima, Notification of Reasons for Rejection (Translation), Oct. 30, 2012, Six pages, Japanese Patent Office, Japan.

*Primary Examiner* — Anthony Stashick
*Assistant Examiner* — Elizabeth Volz
(74) *Attorney, Agent, or Firm* — McGarry Bair PC

(57) ABSTRACT

A collapsible container assembly comprising a folding container having at least four walls, with the at least four walls being pivotable relative to each other to allow the folding container to collapse in a parallelogram motion, and an inside cellular structure connected to the at least four walls. The cellular structure comprises a plurality of interconnected panels forming a plurality of cells, with the panels being formed of soft, deformable material. The folding container can be folded with the inside cellular structure therein such that the collapsible container assembly will be substantially flat when the folding container is moved to a collapsed position.

14 Claims, 22 Drawing Sheets

U.S. PATENT DOCUMENTS

| | | | | | |
|---|---|---|---|---|---|
| 3,011,672 | A | | 12/1961 | Vesak | |
| 3,051,345 | A | | 8/1962 | Flynn | |
| 3,580,471 | A | * | 5/1971 | Burke et al. | 229/120.31 |
| 3,607,440 | A | | 9/1971 | Daniel et al. | |
| 3,621,628 | A | | 11/1971 | Chidsey, Jr. | |
| 3,834,074 | A | | 9/1974 | Shirouzu | |
| 3,843,039 | A | | 10/1974 | Brown et al. | |
| 4,226,357 | A | | 10/1980 | Martin | |
| 4,242,161 | A | | 12/1980 | Hulten et al. | |
| 4,309,175 | A | | 1/1982 | Martin | |
| 4,549,656 | A | | 10/1985 | Barnes et al. | |
| 4,578,899 | A | | 4/1986 | Katila et al. | |
| 4,602,715 | A | | 7/1986 | Sarver et al. | |
| 4,746,053 | A | * | 5/1988 | Nichols | 229/120.36 |
| 5,222,659 | A | | 6/1993 | Peters | |
| 5,601,521 | A | | 2/1997 | Plamas Xapelli | |
| 6,196,449 | B1 | | 3/2001 | Chen | |
| 6,309,334 | B1 | * | 10/2001 | Planas Xapelli | 493/90 |
| 2005/0109655 | A1 | * | 5/2005 | Vershum et al. | 206/521 |
| 2005/0230390 | A1 | * | 10/2005 | Glenn | 220/6 |
| 2007/0000981 | A1 | * | 1/2007 | Jacobs | 229/120.07 |

FOREIGN PATENT DOCUMENTS

| | | | | |
|---|---|---|---|---|
| JP | 56-103419 | U | | 8/1981 |
| JP | 57169640 | | | 10/1982 |
| JP | 57174226 | | * | 10/1982 |
| JP | 2004-224389 | | | 8/2004 |
| KR | 10-1985-0000881 | | | 6/1985 |
| KR | 20-0164152 | Y1 | | 2/2000 |

* cited by examiner

STEP 1
24
14
STEP 2
36
50
28
36
14
32
30
52
24
14
30
STEP 3
50
36
14
14
30
52
STEP 4
50
36
28
28
34
52
24
STEP 5
36
50
36
16
52
14
STEP 6
50
36
34
52
32
32
STEP 7
34
50
28
14
34
52
14
14
24
14
28
28
STEP 8
50
36
36
16
52
STEP 9
36
50
28
16
28
36
32

FIG. 8C"

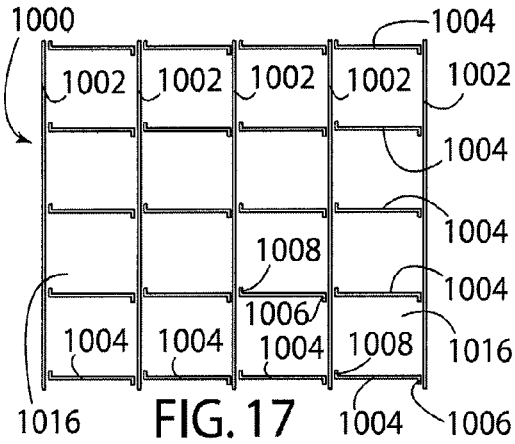
FIG. 17
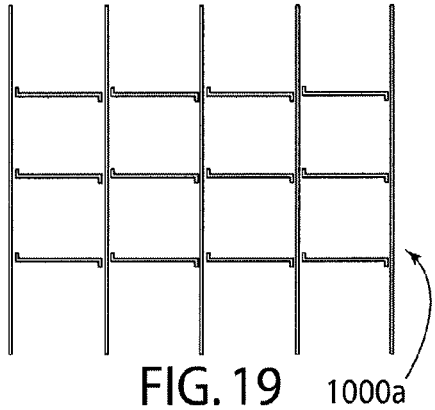
FIG. 19
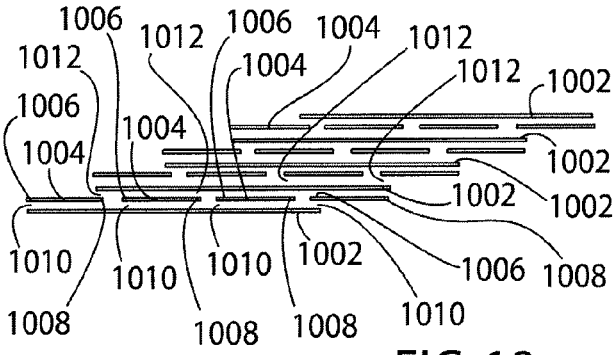
FIG. 18
FIG. 21
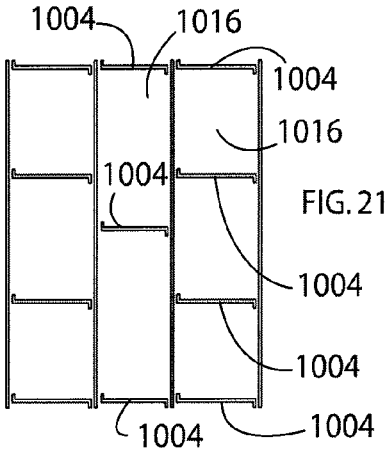
FIG. 21
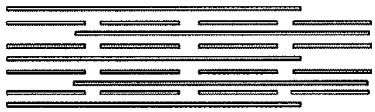
FIG. 20
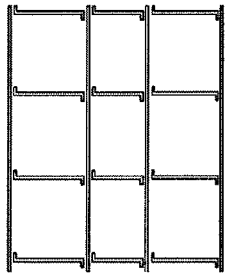
FIG. 22

CELLULAR CONTAINER

CROSS-REFERENCE TO RELATED APPLICATION

This application claims priority to U.S. Provisional Patent Application No. 60/938,045 filed on May 15, 2007 entitled METHOD OF MAKING A CELLULAR CONTAINER.

FIELD OF THE INVENTION

The present invention concerns cellular containers, and more particularly relates to a method for making a cellular container.

SUMMARY OF THE PRESENT INVENTION

Another aspect of the present invention is to provide a collapsible container assembly comprising a folding container having at least two walls pivotable relative to each other a corresponding corner disposed between the at least two walls and an inside cellular structure attached to at least a portion of the at least two walls with a mechanical fastener, adjacent the corner, the cellular structure comprising a plurality of interconnected panels forming a plurality of cells. Each cell has four cell walls, with each cell wall having a thickness of single panel, the cellular structure further comprising a plurality of cells in both an X and Y direction with respect to the cellular structure. The folding container can be folded to a collapsed position in a parallelogram motion with the inside cellular structure therein such that the panels are superimposed and do not intersect one another and wherein the collapsible container assembly will be substantially flat when the folding container is moved to a collapsed position.

In a further aspect of the invention, the mechanical fastener that attaches the inside cellular structure to the at least a portion of the at least two walls, comprises at least one of a glue, at least one staple, or a hook and loop mechanism.

These and other aspects, objects, and features of the present invention will be understood and appreciated by those skilled in the art upon studying the following specification, claims, and appended drawings.

BRIEF DESCRIPTION OF DRAWINGS

FIG. 17 is a top view of a first embodiment of a second collapsible cell assembly of the present invention in an expanded configuration.

FIG. 18 is a side view of the second collapsible cell assembly of the present invention in a fully collapsed configuration (wherein distances are exaggerated for illustration).

FIG. 19 is a top view of a first embodiment of a second collapsible cell assembly of the present invention in an expanded configuration.

FIG. 20 is a side view of the second collapsible cell assembly of the present invention in a fully collapsed configuration (wherein distances are exaggerated for illustration).

FIG. 21 is a third embodiment of the second collapsible cell assembly of the present invention.

FIG. 22 is a fourth embodiment of the second collapsible cell assembly of the present invention.

DETAILED DESCRIPTION OF PREFERRED EMBODIMENTS

Figure 1:
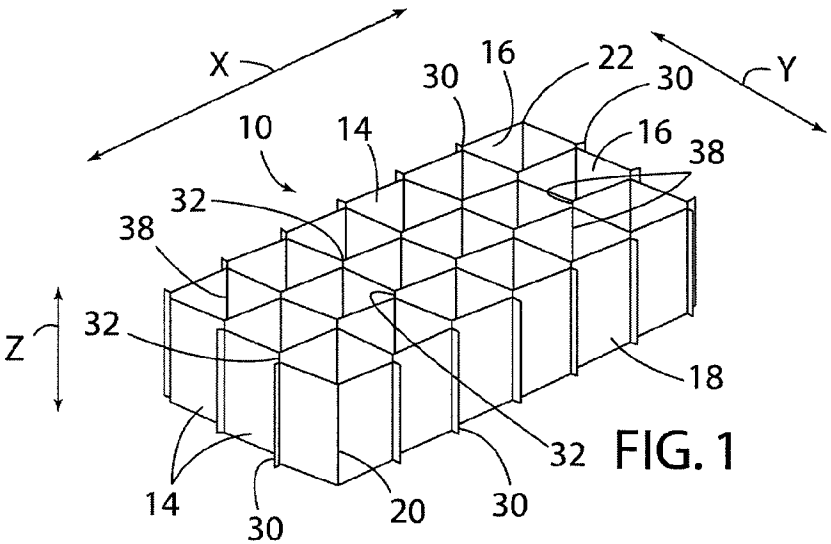
FIG. 1 is a perspective view of a first embodiment of a collapsible cell assembly of the present invention in an expanded configuration.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIGS. 1-3) generally designates a collapsible cell assembly embodying the present invention. In the illustrated example, the collapsible cell assembly 10 comprising a stack 12 of a plurality of panels 14, wherein each panel 14 in the stack 12 is connected to the panels 14 adjacent the particular panel 14 and wherein the stack 12, when fully expanded (see FIG. 1), forms a plurality of substantially rectangular cells 16, with the collapsible cell assembly 10 having a substantially rectangular outside periphery 18.

Figure 2:
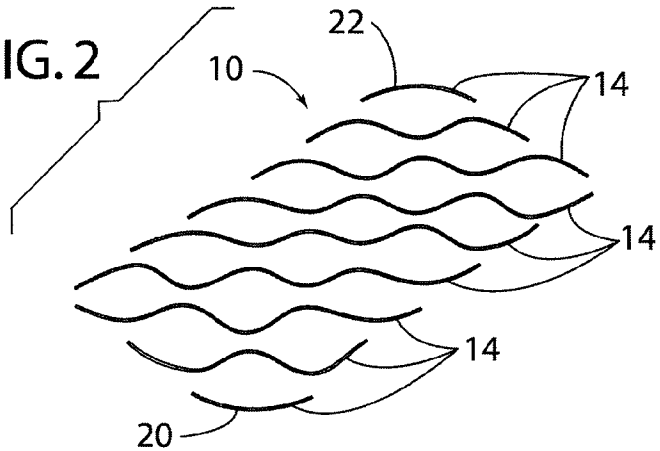
FIG. 2 is a side view of the first embodiment of the collapsible cell assembly of the present invention in a partially collapsed configuration.
Figure 3:
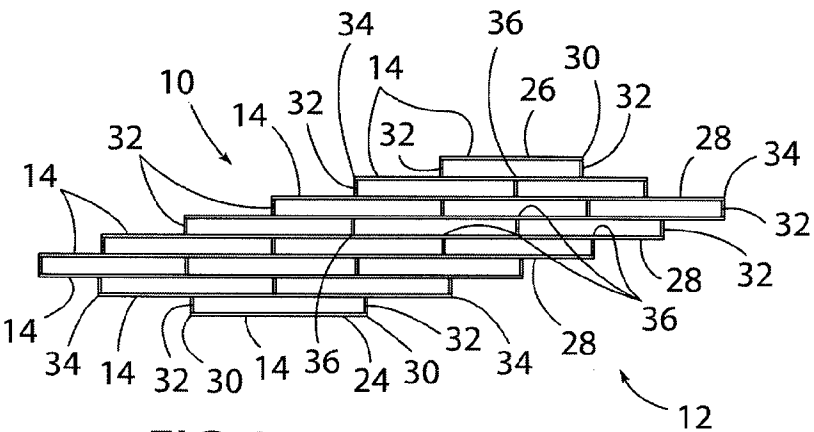
FIG. 3 is a side view of the first embodiment of the collapsible cell assembly of the present invention in a fully collapsed configuration (wherein distances are exaggerated for illustration).

In the illustrated embodiment, the collapsible cell assembly 10 comprises the plurality of panels 14. The panels 14 could be made of any flexible, partially flexible or rigid material. Moreover, it is contemplated that the panels 14 could be made of stretchable material. For example, the panel 14 could be made of fabric. If the panels 14 are made of a rigid material, it is contemplated that the panels 14 could comprise corrugated plastic or chip boards. Furthermore, it is contemplated that the panels 14 of a single collapsible cell assembly 10 could comprise panels 14 of different material (e.g., some flexible, some partially flexible and/or some being rigid) or a single panel could comprise more than one material (e.g., corrugated plastic covered by fabric). Moreover, the rigid materials (or any material) could be scored, pre-bent, or creased to assist expanding the collapsible cell assembly 10 as discussed in more detail below. As illustrated in FIG. 1, when the stack 12 is expanded, the collapsible cell assembly 10 has a substantially rectangular outside periphery 18. However, the collapsible cell assembly 10 could be collapsed by moving a first corner 20 of the collapsible cell assembly 10 towards a second corner 22 of the collapsible cell assembly 10. FIGS. 1-3 illustrate the collapsible cell assembly 10 with eighteen cells 16 in a 3×6 configuration. However, it is contemplated that the collapsible cell assembly 10 could have any number of cells. For example, the collapsible cell assembly 10 could have the following configurations: 1×2, 1×3, 2×2, 2×3, 3×3 (FIG. 4), 4×6, or any other configuration. The list above is illustrative and not exhaustive. Any object could be placed into the cells 16 of the collapsible cell assembly 10 for shipping or storage.

The illustrated collapsible cell assembly 10 includes the stack 12 of panels 14, wherein each panel 14 in the stack 12 is connected to the panels 14 adjacent the particular panel 14. The collapsible cell assembly 10 includes a bottom panel 24, a top panel 26 and at least one intermediate panel 28. Both of the bottom panel 24 and top panel 26 includes ends 30 connected to an adjacent panel 14 at connection points 32. Furthermore, each intermediate panel 28 includes ends 34 and at least one middle section 36 connected to an adjacent panel 14 at connection points 32. For example, in FIG. 3, the bottom panel 24 is connected to the intermediate panel 28 thereon at the ends 34 of the bottom panel 24 at the connections points 32. The intermediate panel 28 on the bottom panel 24 is connected to the intermediate panel 28 above the intermediate panel 28 on the bottom panel 24 at the ends 34 and at the middle section 36 at the connection points 32. The same process is followed all the way up to the intermediate panel 28 below the top panel 26 and the top panel 26. Each connection point 32 forms a corner 38 of the cells 16 (see FIGS. 1 and 4). It is noted that the panels 14 could be creased or perforated at the connection point 32 and at the middle of the bottom panel 24 and the top panel 26 to facilitate folding of the panels 26 at the appropriate location (see FIG. 2).

In the illustrated embodiment, each panel 14 of the collapsible cell assembly 10 is connected to the panel 14 above in the stack 12 using the following scheme, with the number equaling the number of connections between two adjacent panels:

$$2,A,Bz,C,2 \tag{1}$$

wherein:

A=progressive count in integers from 2 to B;

B=highest number in the scheme;

z=number of consecutive Bs; and

C=negative progressive count in integers from B to 2; and and wherein the number of cells formed in the assembly is found using the following formula $(B-1)\times(B+z-2)+(2 \text{ if } B=2)$ and the number of panels is found using the following formula $((B-1)\times2)+(z-1)+(2 \text{ if } B=2)$.

Figure 4:
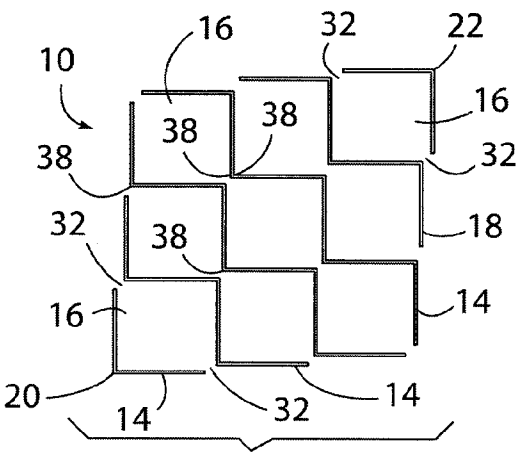
FIG. 4 is a top view of a second embodiment of the collapsible cell assembly of the present invention in an expanded configuration.
Figure 4B:
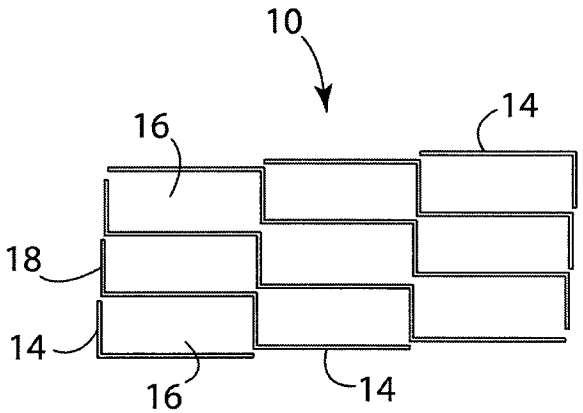
FIG. 4B is a top view of a fourth embodiment of the collapsible cell assembly of the present invention having rectangular cells with long and short sides.
Figure 4A:
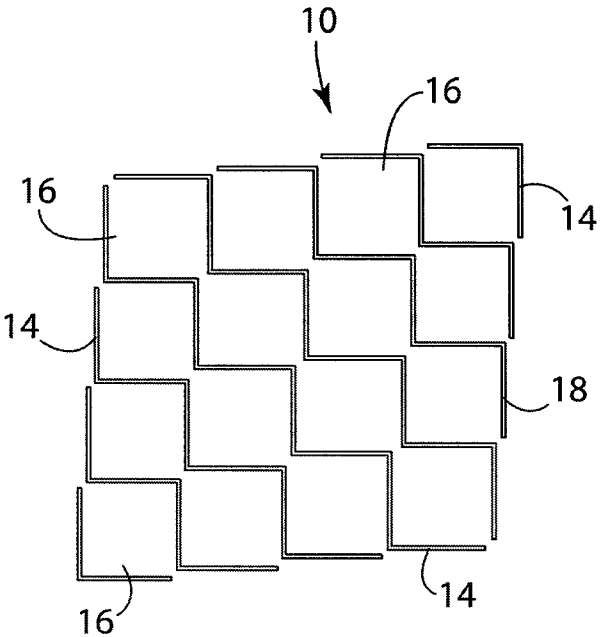
FIG. 4A is a top view of a third embodiment of the collapsible cell assembly of the present invention in an expanded configuration.

Therefore, for the collapsible cell assembly 10 as illustrated in FIGS. 1-3, the scheme is 2, 3, 4, 4, 4, 4, 3, 2. Therefore, in the collapsible cell assembly 10 as illustrated in FIGS. 1-3, A=3, B=4, z=4 and C=3. Therefore, the number of cells 16 in the collapsible cell assembly 10 as illustrated in FIGS. 1-3 is $(4-1)\times(4+4-2)$, which equals 18. Furthermore, the number of panels 14 is $((4-1)\times2)+(4-1)$, which equals 9. Furthermore, for the collapsible cell assembly 10 as illustrated in FIG. 4, the scheme is 2, 3, 4, 3, 2. Therefore, in the collapsible cell assembly 10 as illustrated in FIGS. 1-3, A=3, B=4, z=1 and C=3. Therefore, the number of cells 16 in the collapsible cell assembly 10 as illustrated in FIG. 4 is $(4-1)\times(4+1-2)$, which equals 9. Moreover, for the collapsible cell assembly 10 as illustrated in FIG. 4A, the scheme is 2, 3, 4, 5, 4, 3, 2. Therefore, in the collapsible cell assembly 10 as illustrated in FIG. 4A, A=3, 4, B=5, z=1 and C=4, 3. Therefore, the number of cells 16 in the collapsible cell assembly 10 as illustrated in FIG. 4 is $(5-1)\times(5+1-2)$, which equals 16. Furthermore, the number of panels 14 is $((5-1)\times2)+(1-1)$, which equals 8. Furthermore, the number of panels 14 is $((4-1)\times2)+(1-1)$, which equals 6. The number of cells 16 and panels 14 in any rectangular configuration with substantially rectangular cells 16 of equal size can be found using this formula. It is contemplated that z=0, thereby forming the cell assembly 10 with two cells 16 and three panels 14. See Table 1 below for further examples.

TABLE 1

| B | z | Cells | Panels |
|---|---|---|---|
| 2 | 0 | 2 | 3 |
| 2 | 1 | 3 | 4 |
| 2 | 2 | 4 | 5 |
| 2 | 3 | 5 | 6 |
| 2 | 4 | 6 | 7 |
| 3 | 1 | 4 | 4 |
| 3 | 2 | 6 | 5 |
| 3 | 3 | 8 | 6 |
| 3 | 4 | 10 | 7 |
| 3 | 5 | 12 | 8 |
| 4 | 1 | 9 | 6 |
| 4 | 2 | 12 | 7 |
| 4 | 3 | 15 | 8 |
| 4 | 4 | 18 | 9 |
| 4 | 5 | 21 | 10 |
| 5 | 1 | 16 | 8 |
| 5 | 2 | 20 | 9 |
| 5 | 3 | 24 | 10 |
| 5 | 4 | 28 | 11 |
| 5 | 5 | 32 | 12 |
| 6 | 1 | 25 | 10 |
| 6 | 2 | 30 | 11 |
| 6 | 3 | 35 | 12 |
| 6 | 4 | 40 | 13 |
| 6 | 5 | 45 | 14 |
| 7 | 1 | 36 | 12 |
| 7 | 2 | 42 | 13 |
| 7 | 3 | 48 | 14 |
| 7 | 4 | 54 | 15 |
| 7 | 5 | 60 | 16 |

The above formula can also be used to determine the form of the collapsible cell assembly 10 once it is known how many cells 16 are desired. Once the number of cells 16 is determined, a person making the cell assembly 10 can determine which configurations of assemblies 10 in rows and columns can be used to make that number of cells 16. For example, if the desired number of cells 16 is 332, the configurations could be 1×332, 2×166 or 4×83 (it is noted that prime numbers can only have configurations with one row). For any configuration, B is the number of rows (that is, the lower number in the matrix) plus 1. Therefore, in the 1×332 configuration, B is 2, in the 2×166 configuration, B is 3, and in the 4×83 configuration, B is 5. Furthermore, z can then easily be found using the formula (B−1)×(B+z−2)+(2 if B=2), which worked for $$z=\text{number of cells}-B2+3B-2+(1 \text{ if } B=2)$$

B−1

Therefore, in the illustrated example, number of cells=332, and B can equal 2, 3 or 5. When B is 2, z=333, when B is 3, z=115 and when B=5, z=80.

Figure 4C:
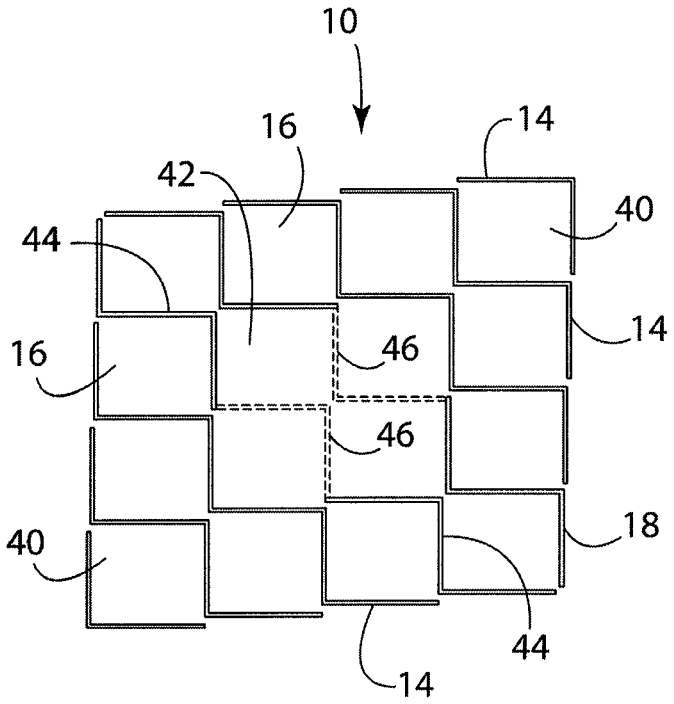
FIG. 4C is a top view of a fifth embodiment of the collapsible cell assembly of the present invention having a larger inner cell.
Figure 4D:
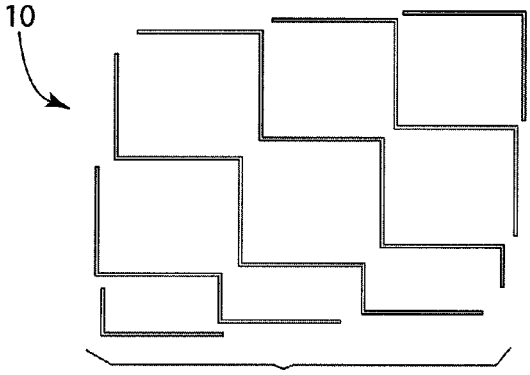
FIG. 4D is a top view of a sixth embodiment of the collapsible cell assembly of the present invention having cells of different sizes in an unassembled configuration.
Figure 4E:
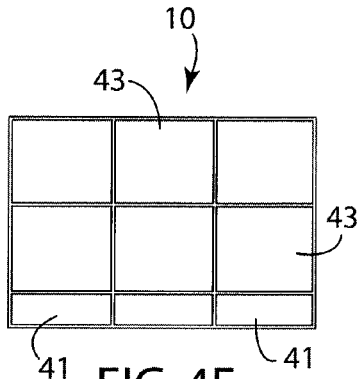
FIG. 4E is a top view of the sixth embodiment of the collapsible cell assembly of the present invention having cells of different sizes in an assembled configuration.
Figure 4F:
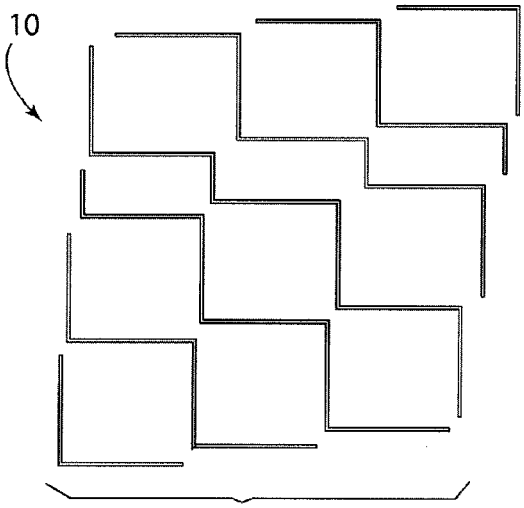
FIG. 4F is a top view of a seventh embodiment of the collapsible cell assembly of the present invention having cells of different sizes in an unassembled configuration.
Figure 4G:
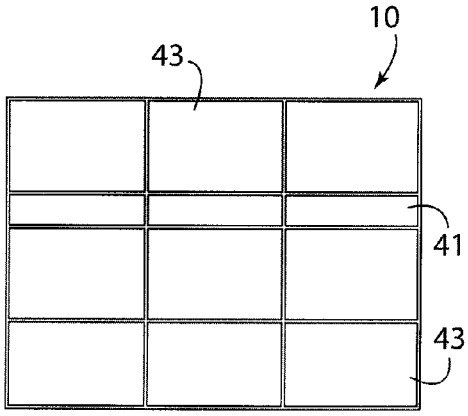
FIG. 4G is a top view of the seventh embodiment of the collapsible cell assembly of the present invention having cells of different sizes in an assembled configuration.
Figure 4H:
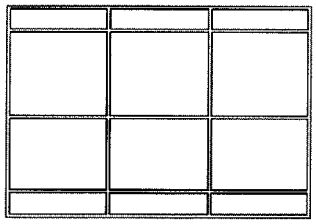
FIG. 4H is a top view of an eighth embodiment of the collapsible cell assembly of the present invention having cells of different sizes in an assembled configuration.
Figure 4I:
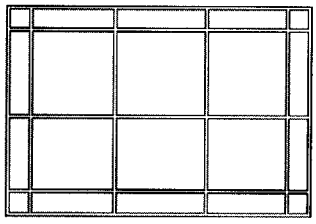
FIG. 4I is a top view of a ninth embodiment of the collapsible cell assembly of the present invention having cells of different sizes in an assembled configuration.

In the illustrated example, the cells 16 of the collapsible cell assembly 10 are substantially square. However, it is contemplated that the cells 16 could be rectangular. For example, FIG. 4B illustrates a configuration of the collapsible cell assembly 10 wherein the cells 16 are rectangular. Furthermore, it is contemplated that the collapsible cell assembly 10 could have small outside cells 40 and one or more larger inside cells 42 as illustrated in FIG. 4C. As illustrated in FIG. 4C, the center two intermediate panels 28 are formed in two mini-panels 44, with the remainder of the mini-panels 44 removed (shown as dashed lines 46), thereby forming twelve small outside cells 40 and one larger inside cell 42. The one or more larger inside cells 42 can be formed in any configuration of the collapsible cell assembly 10 having at least a four by four cell 16 configuration. It is contemplated that the collapsible cell assembly 10 could have cells 16 of various sizes. For example, FIGS. 4D (unconnected) and 4E (connected) illustrate the collapsible cell assembly 10 with one row of smaller cells 41 and two rows of larger cells 43. Likewise, FIGS. 4F (unconnected) and 4G (connected) illustrate the collapsible cell assembly 10 with one row of smaller cells 41 and three rows of larger cells 43. Any of the rows or columns of cells could have cells larger or smaller than rows or columns of other cells. It is further contemplated that the collapsible cell assembly 10 could have any number of cells in any row or column that are larger or smaller than other cells in the collapsible cell assembly 10 as illustrated in FIGS. 4H and 4I.

Figure 5:
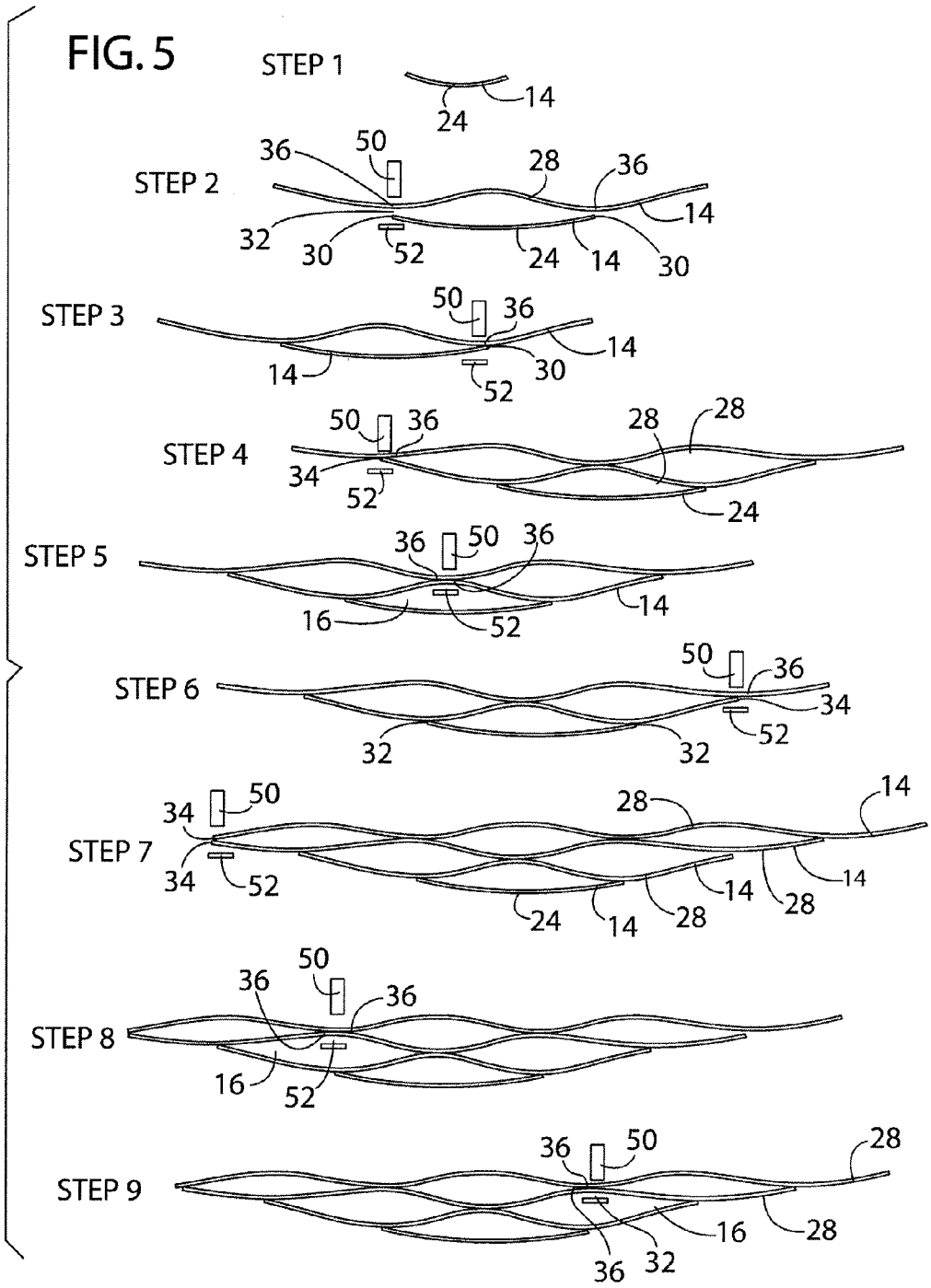
FIG. 5 illustrates a first method of making the collapsible cell assembly of the present invention (with the panels having a slight curve for illustrative purposes even though the panels will be substantially flat during the method).

The panels 14 of the illustrated collapsible cell assembly 10 can be connected in any manner. For example, the panels 14 connected at the connection points 32 can be welded (e.g., using sonic welding techniques well known to those skilled in the art), gluing, stapling, sewing, heating, or by having a perforation interlock scheme at the connection points 32 of each panel 14. The panels 14 can be connected at the connection points along the entire height of the panels (thereby creating a very strong connection between the panels and allowing for a material with a low density and strength) or can be for only a portion of the height (continuous or interrupted). FIG. 5 illustrates a first method of making the collapsible cell assembly of the present invention using ultrasonic welding. First, in Step 1, the bottom panel 24 is placed in a work surface. In Step 2, a first intermediate panel 28 is then placed on top of the bottom panel 24 and a first middle section 36 of the first intermediate panel 28 is connected to a first end 30 of the bottom panel 24 at the connection point 32 by having an ultrasonic welding device 50 as is well known to those skilled in the art contact the connection point 32 and weld the first intermediate panel 28 to the bottom panel 24. In Step 3, a second middle section 36 of the intermediate panel 28 is connected to a second end 30 of the bottom panel 24 using the ultrasonic welding device 50.

In Step 4, a second intermediate panel 28 is then placed on top of the first intermediate panel 28 and a first middle section 36 of the second intermediate panel 28 is connected to a first end 34 of the first intermediate panel 28 using the ultrasonic welding device 50. In Step 5, a second middle section 36 of the second intermediate panel 28 is connected to a third middle section 36 of the first intermediate panel 28 using the ultrasonic welding device 50. It is noted in Step 5 that an anvil or similar device 52 is inserted into the cell 16 formed by the bottom panel 24 and the first intermediate panel 28 directly below the ultrasonic welding device 50 to prevent the bottom panel 24 from being connected to the first intermediate panel 28 during this step. In Step 6, a third middle section 36 of the second intermediate panel 28 is connected to a second end 34 of the first intermediate panel 28 using the ultrasonic welding device 50.

In Step 7, a third intermediate panel 28 is then placed on top of the second intermediate panel 28 and a first end 34 of the third intermediate panel 28 is connected to the first end 34 of the second intermediate panel 28 using the ultrasonic welding device 50. In Step 8, a first middle section 36 of the third intermediate panel 28 is connected to a fourth middle section 36 of the second intermediate panel 28 using the ultrasonic welding device 50. Once again, the anvil or similar device 52 is inserted into the cell 16 formed by the first intermediate panel 28 and the second intermediate panel 28 directly below the ultrasonic welding device 50 to prevent the second intermediate panel 28 from being connected to the first intermediate panel 28 during this step. In Step 9, a second middle section 36 of the third intermediate panel 28 is connected to fifth middle section 36 of the second intermediate panel 28 using the ultrasonic welding device 50. The anvil or similar device 52 is also used in this step. The process of FIG. 5 is continued until all of the connection points 32 of the collapsible cell assembly 10 are made.

It is noted that during the process of FIG. 5, the panels 14 can be moved relative to the ultrasonic welding device 50 and anvil or similar device 52 by moving the panels 14 and keeping the ultrasonic welding device 50 and anvil or similar device 52 stationary, by moving the ultrasonic welding device 50 and anvil or similar device 52 and keeping the panels 14 stationary, or by moving the ultrasonic welding device 50, the anvil or similar device 52, and the panels 14. It is further noted that any of the connections methods (e.g., stapling, gluing) can be used in the process of FIG. 5 (with a staple gun or glue gun being substituted for the ultrasonic welding device 50).

Figure 6:
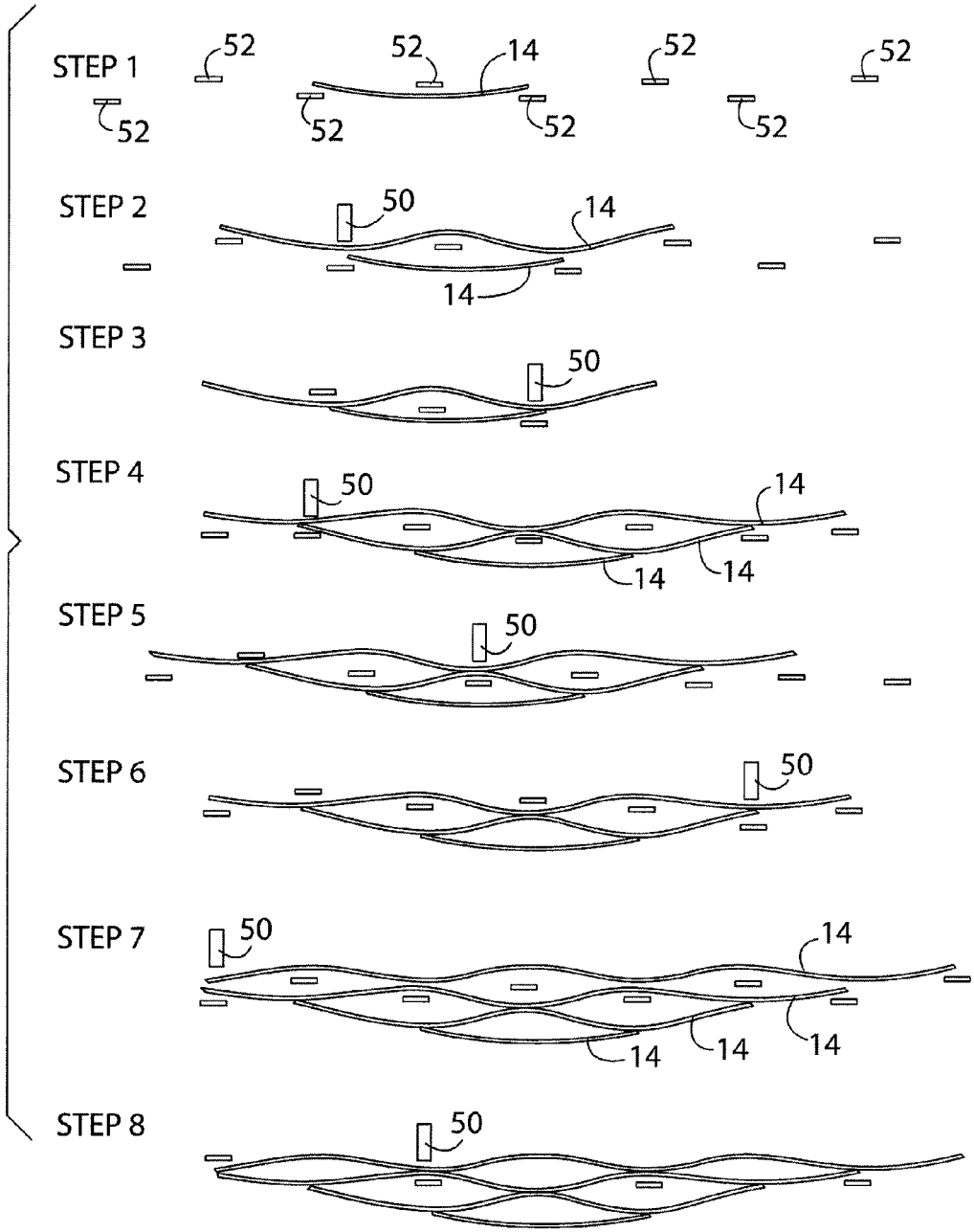
FIG. 6 illustrates a second method of making the collapsible cell assembly of the present invention (with the panels having a slight curve for illustrative purposes even though the panels will be substantially flat during the method).

FIG. 6 illustrates a second method of making the collapsible cell assembly 10 of the present invention using ultrasonic welding. The method of FIG. 6 differs from the method of FIG. 5 by using multiple anvils or similar devices 52. Therefore, during each set of steps wherein one panel is connected to an adjacent panel, the anvil or similar device 52 does not have to be removed from one cell 16 and inserted into another cell 16 before subsequent welding (or other attachment methods) is started. It is contemplated that the plurality of anvil or similar devices 52 could be all on the same horizontal plane or staggered with every other anvil or similar device 52 being lower than the two adjacent anvil or similar devices 52 (see, for example, Step 7 of FIG. 6). Moreover, it is contemplated that the welding can take place in any order (e.g., a first end weld between two panels can be made, a second end weld between the two panels can be made and then the middle welds between the two panels can be made). Furthermore, it is noted that only every other anvil or similar device 52 is used for each set of steps connected to adjacent panels 12. It is further noted that the method of making the collapsible cell assembly 10 could include a plurality of ultrasonic welding devices 50 (or other connection device) instead of a plurality of anvil or similar devices 52 or could includes a plurality of ultrasonic welding devices 50 (or other connection device) and a plurality of anvil or similar devices 52.

Figure 7:
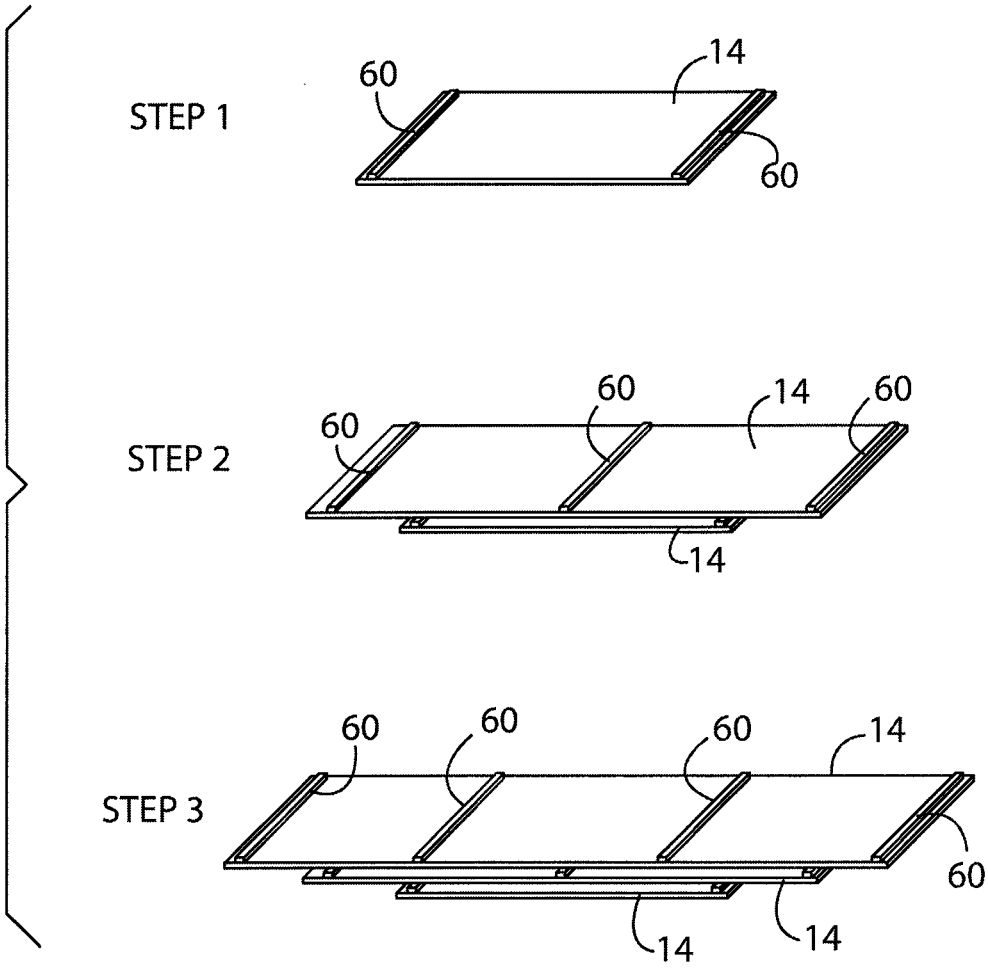
FIG. 7 illustrates a third method of making the collapsible cell assembly of the present invention.

FIG. 7 illustrates a third method of making the collapsible cell assembly 10 of the present invention using glue. The method of FIG. 7 differs from the method of FIG. 5 by using glue strips 60 instead of an ultrasonic welding device 50. Therefore, during each set of steps wherein one panel is connected to an adjacent panel, glue is applied to the top and/or bottom of the panel 14 at the connection points 32. The glue can be applied using a glue gun, glue strips, spaced glue dots or any other manner. It is noted that the anvil or similar device 52 does not have to be used in the method as illustrated in FIG. 7.

Figure 8A:
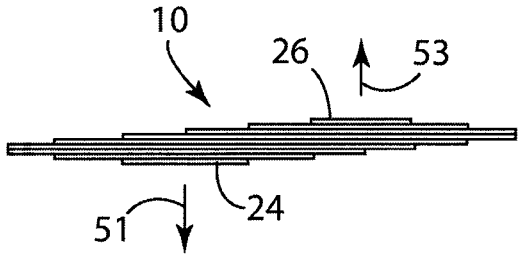
FIG. 8A illustrates the collapsible cell assembly in a fully collapsed position.
Figure 8B:
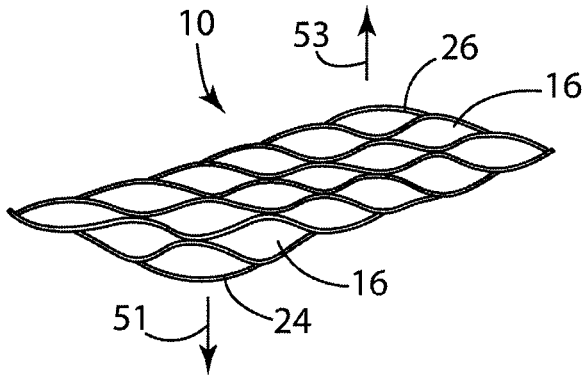
FIG. 8B illustrates the collapsible cell assembly in a partially expanded position.
Figure 8C:
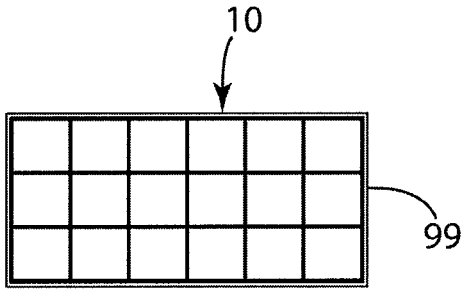
FIG. 8C'-8C''' illustrate several embodiment of the collapsible cell assembly in a fully expanded position and in a container.
Figure 8C:
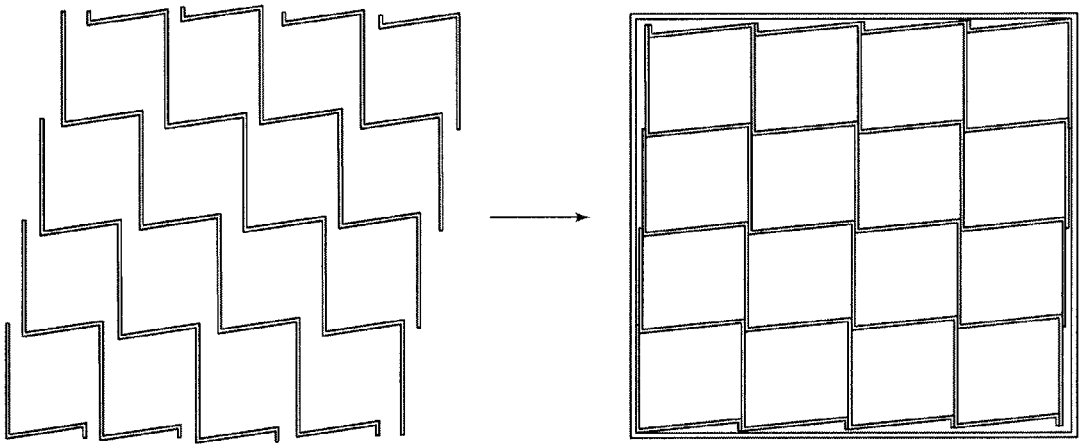
Figure 8C:
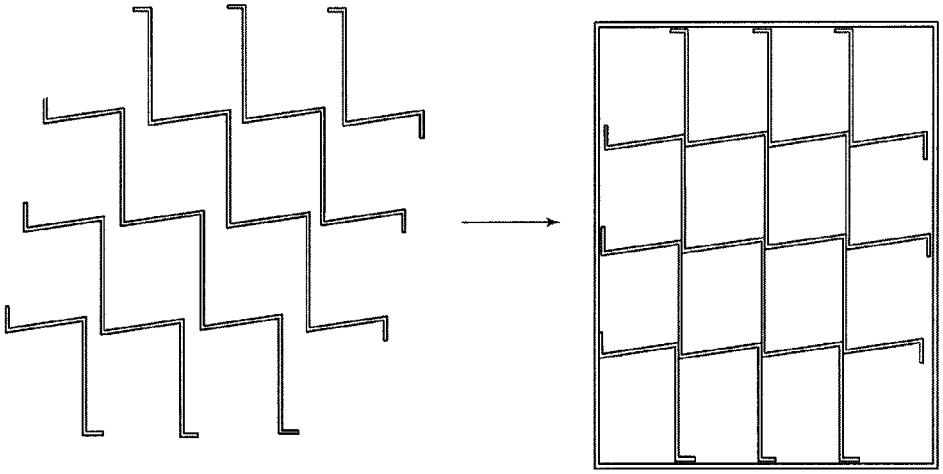

Accordingly, the collapsible cell assembly 10 can be made by cutting the panels 14 to size, laid flat and connected as discussed above. FIG. 8A illustrates the collapsible cell assembly 10 once formed wherein the panels 14 are laid flat. To expand the cells 16, the bottom panel 24 and the top panel 26 are pulled apart along line 51 and line 53, respectfully. The collapsible cell assembly 10 can be partially expanded as illustrated in FIG. 8B by continuing to pull the bottom panel 24 and the top panel 26 apart along line 51 and 53, respectfully. Finally, once fully expanded as illustrated in FIG. 8C', the collapsible cell assembly 10 can form a rectangle. With the process of making the collapsible cell assembly 10, the finished product will have cells 16 in at least one row (Y in FIG. 1) and at least one column (X is FIG. 1), with each cell 16 having a height (Z in FIG. 1). With the configuration in FIG. 1, the collapsible cell assembly 10 can have panels 14 according to Table 2 for a collapsible cell assembly 10 having a 3 cell by 6 cell configuration.

TABLE 2

| Panel | Walls of Cells in Units in Y and X Directions |
|---|---|
| Bottom panel | one Y and one X |
| $1^{st}$ intermediate panel | one Y, one X, one Y, and one X |
| $2^{nd}$ intermediate panel | one Y, one X, one Y, one X, one Y, and one X |
| $3^{rd}$ intermediate panel | one X, one Y, one X, one Y, one X, one Y, and one X |
| $4^{th}$ intermediate panel | one X, one Y, one X, one Y, one X, one Y, and one X |
| $5^{th}$ intermediate panel | one X, one Y, one X, one Y, one X, one Y, and one X |
| $6^{th}$ intermediate panel | one X, one Y, one X, one Y, one X, and one Y |
| $7^{th}$ intermediate panel | one X, one Y, one X, and one Y |
| Top panel | one X, and one Y |

Figure 8D:
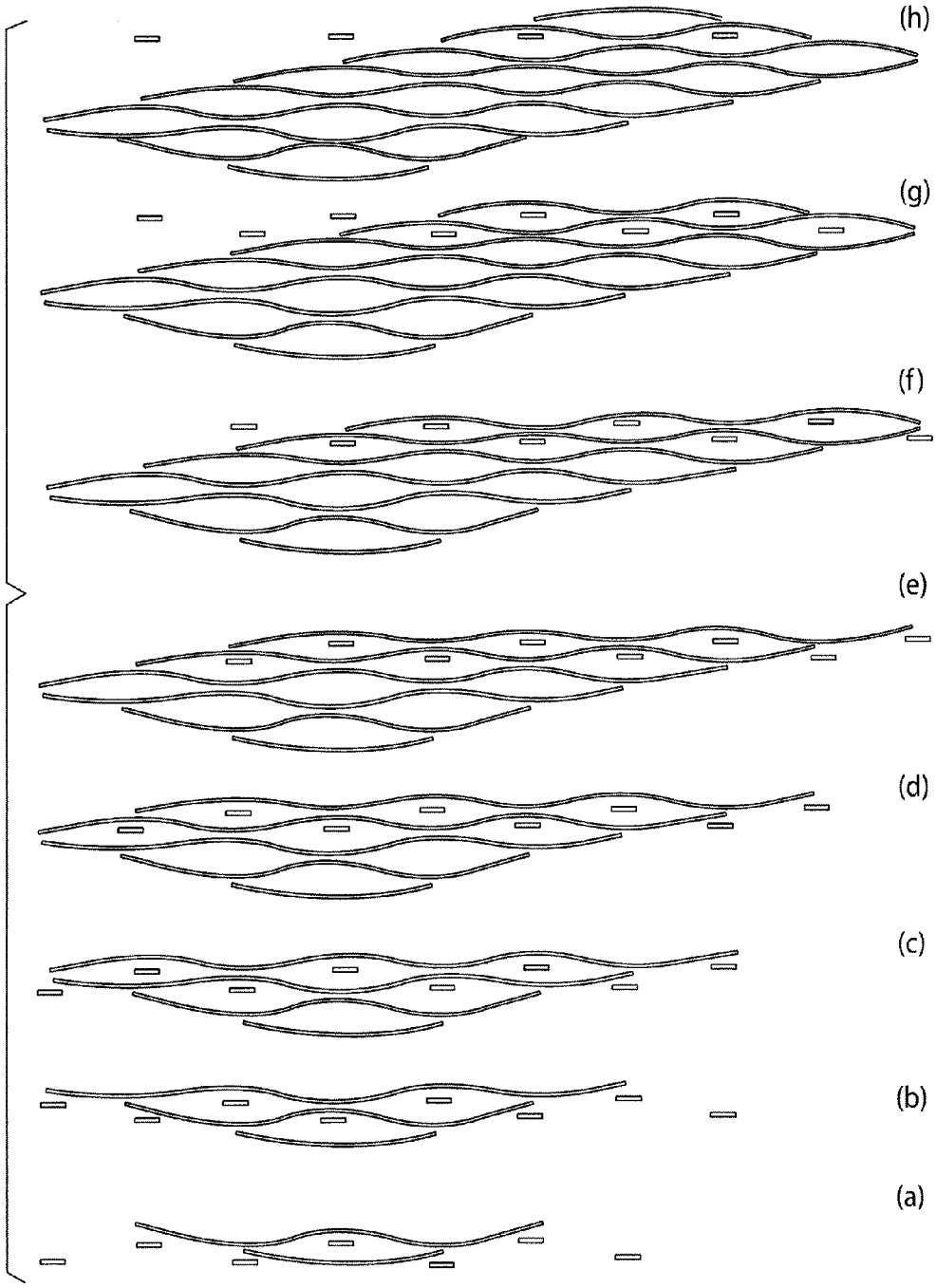
FIG. 8D illustrates another way to describe the method of making the collapsible cell assembly of FIG. 8A.

It is noted that the panels before and after the longest panels will have opposite walls configurations (e.g., panel before longest has one Y, one X, one Y, one X, one Y, and one X while the panel after the longest has one X, one Y, one X, one Y, one X, and one Y, the panel two before the longest has one Y, one X, one Y, and one X while the panel two after the longest has one X, one Y, one X, and one Y, etc.) Such a method is illustrated in FIG. 8D, wherein the bottom panel is two walls long (FIG. 8D(a)), the 1st intermediate panel is four walls long (FIG. 8D(a)), the 2nd intermediate panel is six walls long (FIG. 8D(b)), the 3rd intermediate panel is seven walls long (FIG. 8D(c)), the 4th intermediate panel is seven walls long (FIG. 8D(d)), the 5th intermediate panel is seven walls long (FIG. 8D(e)), the 6th intermediate panel is six walls long (FIG. 8D(f)), the 7th intermediate panel is four walls long (FIG. 8D(g)), and the top panel is two walls long (FIG. 8D(h)).

Once fully expanded, the collapsible cell assembly 10 can be placed into a container 99 by connecting the outside periphery of the collapsible cell assembly 10 to the interior of the walls of the container 99 (with full outer walls as shown in FIGS. 8C' and 8C" or without outer walls as shown in FIG. 8C'''). In this arrangement, each wall of each of the cells 16 (formed by the panels 14) is substantially parallel to two of the walls of the container and substantially perpendicular to two of the walls of the container. However, it is contemplated that the collapsible cell assembly 10 could be used when only partially expanded, with each of the cells 16 substantially forming parallelograms. In this configuration, each wall of each of the cells 16 is parallel to two of the walls of the container. It is noted that the collapsible cell assembly 10 could also be placed into a container that in a collapsed or partially collapsed position, with the collapsible cell assembly 10 each wall of each of the cells 16 (formed by the panels 14) being parallel to two of the walls of the container (and possibly perpendicular to two of the walls of the container) once the container is expanded).

It is contemplated that the collapsible cell assembly 10 could be connected to the container in any manner. For example, the collapsible cell assembly 10 could be glued or stapled to the walls. Furthermore, it is contemplated that the outside periphery of the collapsible cell assembly 10 and the interior of the walls could be engaged using a hook and loop mechanism (e.g., Velcro), with one of the hooks or loops being connected to the collapsible cell assembly and the other of the hooks or loops being connected to the interior of the walls. It is further contemplated that the container could have corners that are hinged or otherwise pivotable to allow the container to be collapsible along with the collapsible cell assembly 10. Moreover, it is contemplated that a plurality of collapsible cell assemblies 10 could be formed by making a horizontal cut (perpendicular to the Z direction in FIG. 1) through the entire the collapsible cell assembly 10, thereby creating two collapsible cell assemblies 10.

Figure 9A:
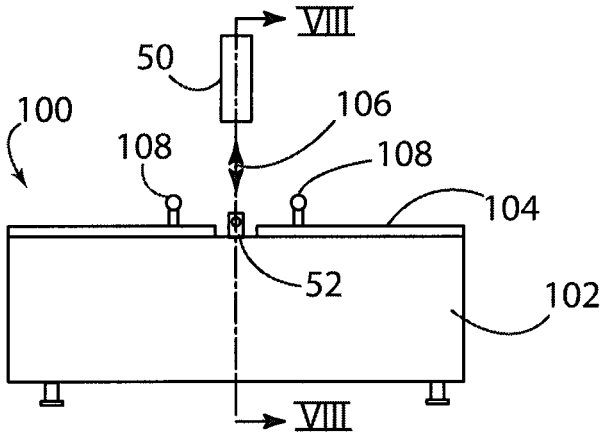
FIG. 9A is a front view of a sealing machine for use in making the collapsible cell assembly of the present invention.
Figure 9B:
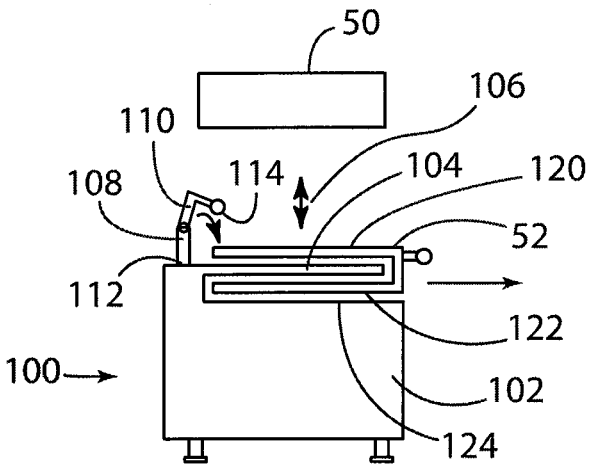
FIG. 9B is a cross-sectional view of the sealing machine for use in making the collapsible cell assembly of the present invention taken through the line IX-IX of FIG. 9A.

FIGS. 9A and 9B illustrate schematically a sealing machine 100 for use with the method of FIG. 5 above. The sealing machine 100 includes the ultrasonic welding device 50 and the anvil or similar device 52. As illustrated in FIGS. 9A and 9B, the sealing machine 100 includes a table 102 having a surface 104 for supporting the collapsible cell assembly 10 during assembly. During each sealing or connecting step, the ultrasonic welding device 50 moves downward along arrow 106 to contact the panels 14 above the anvil or similar device 52. The sealing machine 100 can include a pair of clamps 108 on each side of the anvil or similar device 52 for holding the panels 14 in position during the sealing or connecting step. The clamps 108 include a pivotable portion 110 and a stationary portion 112, with the pivotable portion 110 rotating relative to the stationary portion 112. The pivotable portion 110 includes a head 114 for holding the panels 14. In the illustrated embodiment, the anvil or similar device 52 is U-shaped and includes a top portion 120 for being inserted into a cell 16 of the cell assembly 10 during construction as discussed above and a bottom portion 122 configured to be slid into an opening 124 in the table 102. The table 102 can include roller bearings or other items to allow the anvil or similar device 52 to easily side into and out of the opening 124. It is contemplated that the sealing machine 100 could have a foot activated lever for moving the ultrasonic welding device 50 into contact with the panels 14. It is further contemplated that the ultrasonic welding device 50 in FIGS. 9A and 9B could be substituted with a staple gun or other connection device. It is also contemplated that the upper portion 120 could include a design or words for imprinting into the panels 14 during the sealing or connection steps. It is further contemplated that the anvil or similar device 52 could only include the top portion 120 and inserted into the cells 16 by itself.

Figure 10:
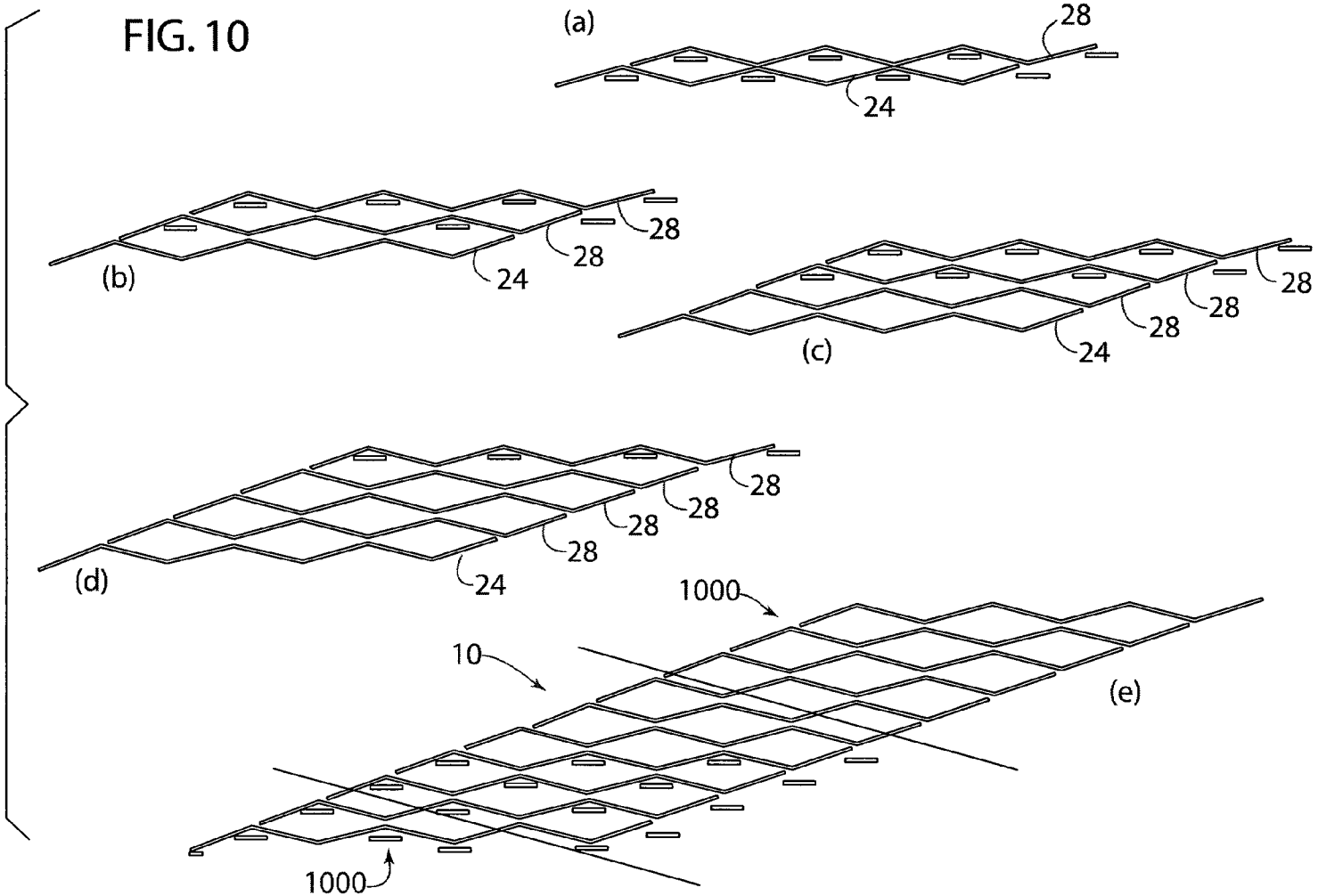
FIG. 10 illustrates a fourth method of making the collapsible cell assembly of the present invention.

FIG. 10 illustrates another method of making the collapsible cell assembly 10 of the present invention. In the method of FIG. 10, all of the panels 14 have the same length. Therefore, the bottom panel 24 is placed on a support surface and an intermediated panel 28 is placed on the bottom panel 24 and connected thereto. Both the bottom panel 24 and the intermediate panel 28 have the same length. This process can continue as long as desired. Once the connection of the panels with the same length has stopped, the cell assembly can be cut to form a collapsible cell assembly with plurality of substantially rectangular cells with walls that are configured to be either substantially perpendicular or substantially parallel to a container wall by cutting off end sections 1000 of the assembly (to form, for example, a three by four collapsible cell assembly as illustrated in FIG. 10(*e*)).

Figure 11A:
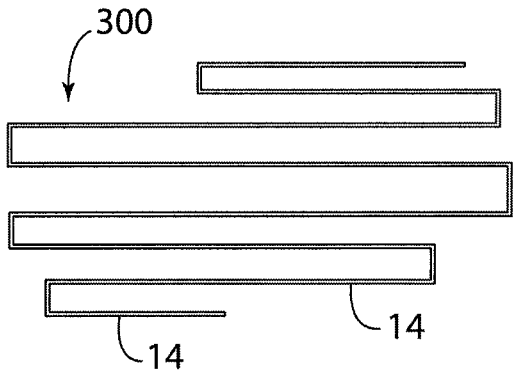
FIGS. 11A-11C illustrate another method of making the collapsible cell assembly of the present invention using one or more sheets to form a plurality of the panels.
Figure 11B:
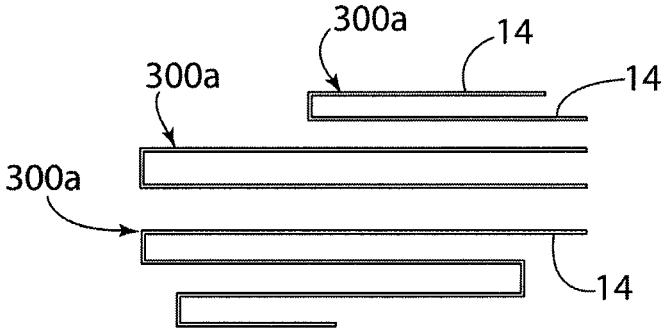
Figure 11C:
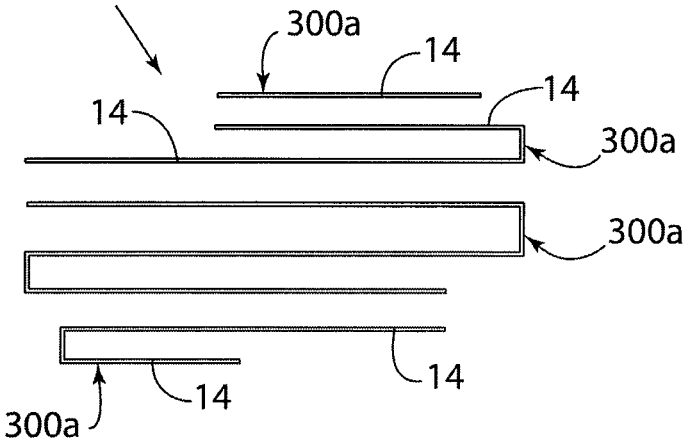

FIGS. 11A-11B illustrate another method of making the collapsible cell assembly 10 of the present invention. In the methods of FIG. 11A-11C, at least some of the panels 14 are connected at ends thereof to adjacent panels 14 (i.e., the panels 14 are not all separate). Therefore, the panels 14 are formed from one connected sheet 300 as illustrated in FIG. 11A or from several sheets 300*a* as illustrated in FIGS. 11B and 11C. It is contemplated that any number of sheets 300*a* in any configuration could be used.

Figure 12A:
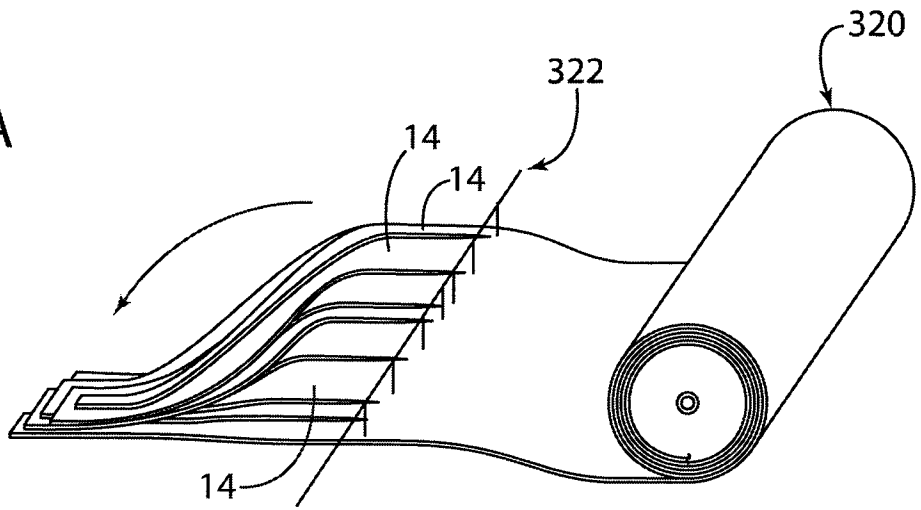
FIG. 12A illustrates yet another method of mating the collapsible cell assembly.

FIG. 12A illustrates yet another method of making the collapsible cell assembly 10 of the present invention. FIG. 12A illustrates a high speed and automated process for forming the collapsible cell assembly 10. As illustrated in FIG. 12A, the panels 14 are formed from one large roll 320 of material. As the large roll 320 of material is unrolled, the material is cut into individual panels 14 by a cutting device 322. The individual panels 14 are then aligned and stacked. The panels 14 are then connected to each other using any of the connection methods described above (e.g., those described in association with FIGS. 5-7). Thereafter, if desired, a plurality of collapsible cell assemblies 10 could be formed by making a horizontal cut (perpendicular to the Z direction in FIG. 1) through the entire the collapsible cell assembly 10 as discussed above. Finally, if desired, the collapsible cell assemblies 10 can be placed into containers 99 as discussed above.

Figure 12B:
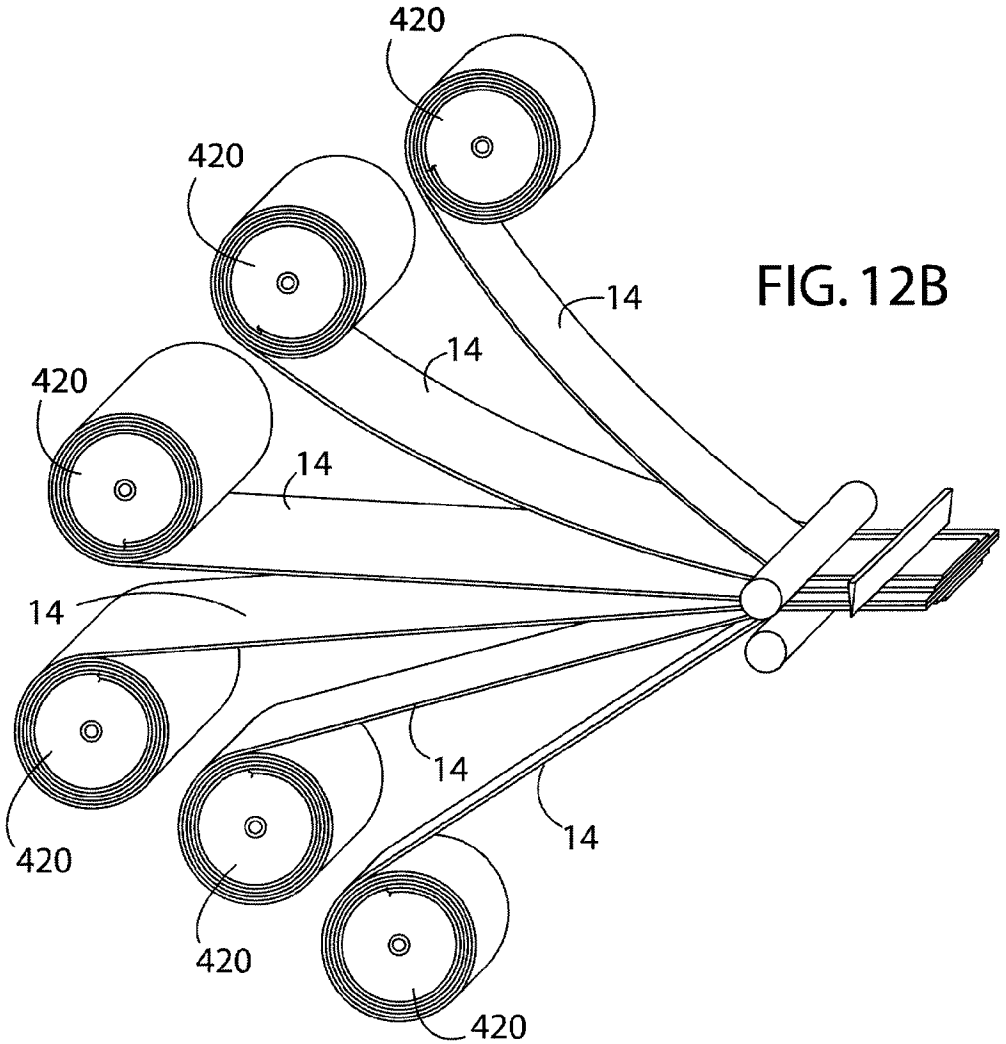
FIG. 12B illustrates yet one more method of mating the collapsible cell assembly.

FIG. 12B illustrates yet one more method of making the collapsible cell assembly 10 of the present invention. FIG. 12B illustrates a high speed and automated process for forming the collapsible cell assembly 10. As illustrated in FIG. 12B, the panels 14 are formed from several rolls 420 of material. As the rolls 420 of material are unrolled, the material from each roll 420 is placed adjacent the material from an adjacent roll 420 by aligning and stacking the material. The panels 14 are then connected to each other using any of the connection methods described above (e.g., those described in association with FIGS. 5-7). For example, the panels 14 can have glue applied thereto in an automatic fashion, the material can be pressed together and the material can be cut. Furthermore, it is contemplated that the material can be placed on the rolls 420 with preformed creases or can be creased after coming from the rolls 420 but before the material is aligned and stacked. Thereafter, if desired, a plurality of collapsible cell assemblies 10 could be formed by making a horizontal cut (perpendicular to the Z direction in FIG. 1) through the entire the collapsible cell assembly 10 as discussed above. Finally, if desired, collapsible cell assemblies 10 can be placed into containers 99 as discussed above.

Figures 13A, 13B, 13C:
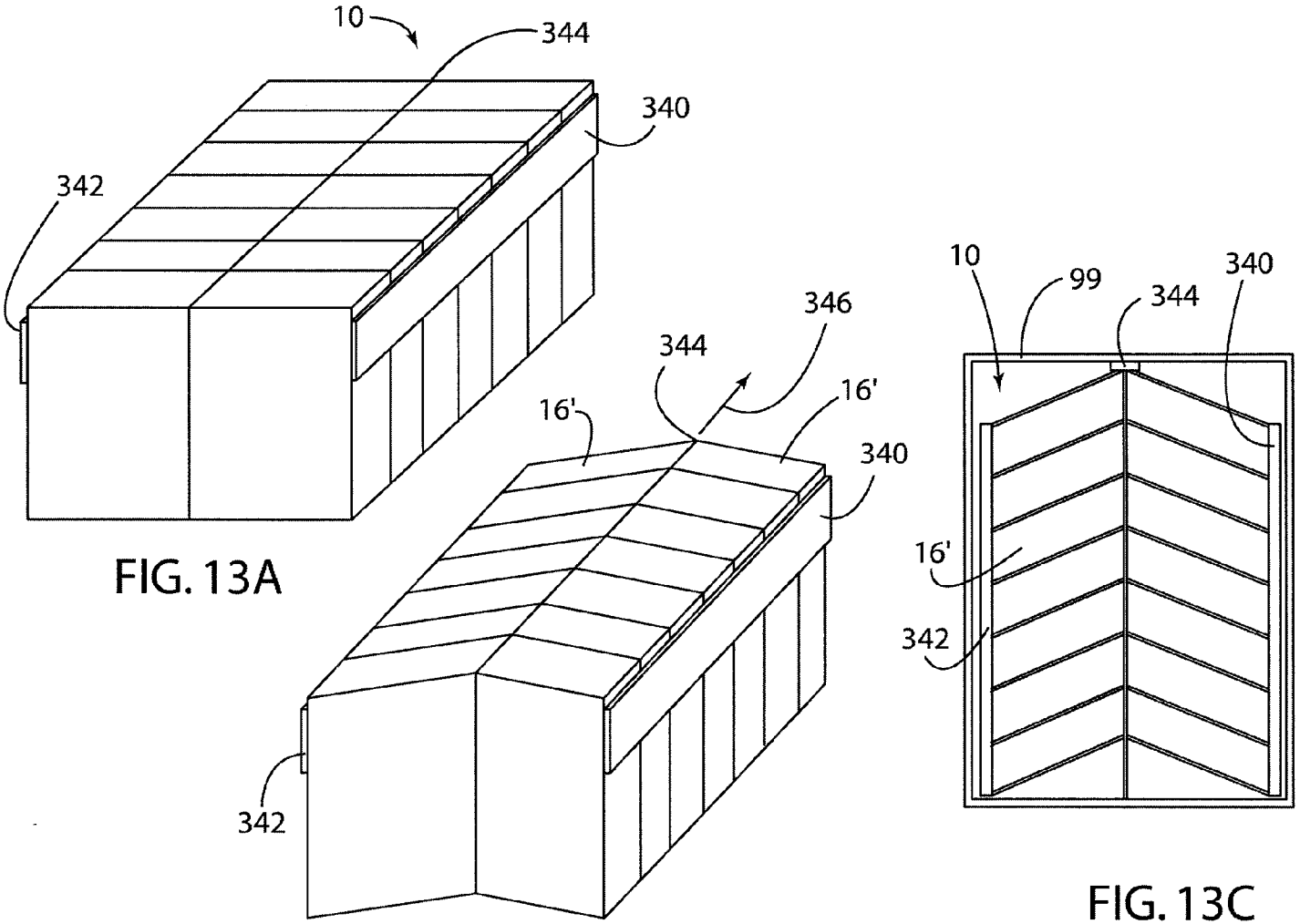
FIGS. 13A-13C illustrate a collapsible cell assembly of the present invention with parallelogram cells.

FIGS. 13A-13B illustrate another embodiment of the collapsible cell assembly 10. As illustrated in FIG. 13A, the collapsible cell assembly 10 is formed using any of the methods described above and includes a first side pane 340, a second side pane 342 and an end pane 344 attached to the collapsible cell assembly 10. The end pane 344 is then pulled along line 346 as illustrated in FIG. 13B to turn the cells 16 from rectangles to parallelogram cells 16'. The collapsible cell assembly 10 with the parallelogram cells 16' is then placed into a container 99, with the first side pane 340, the second side pane 342 and the end pane 344 being connected to inside walls of the container as illustrated in FIG. 13C.

Figure 14A:
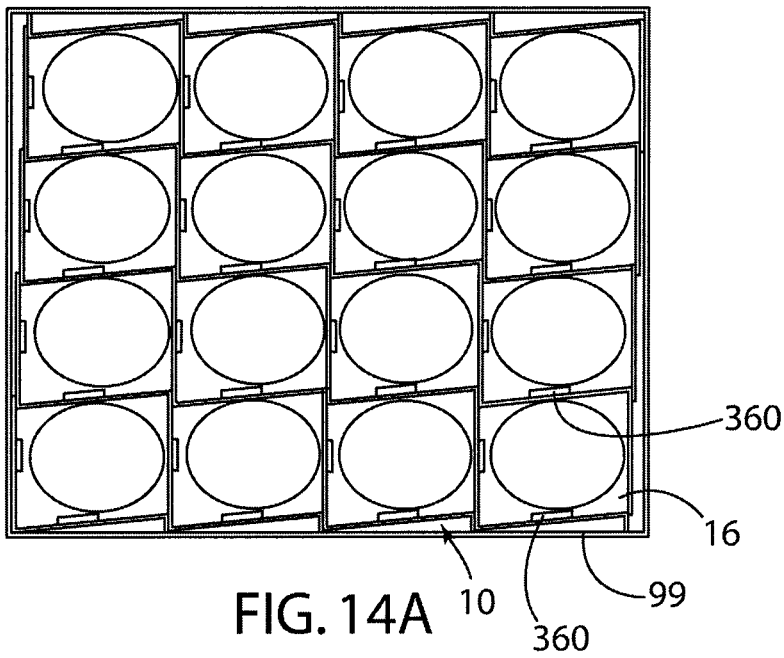
FIGS. 14A and 14B illustrate a collapsible cell assembly of the present invention with padding.
Figure 14B:
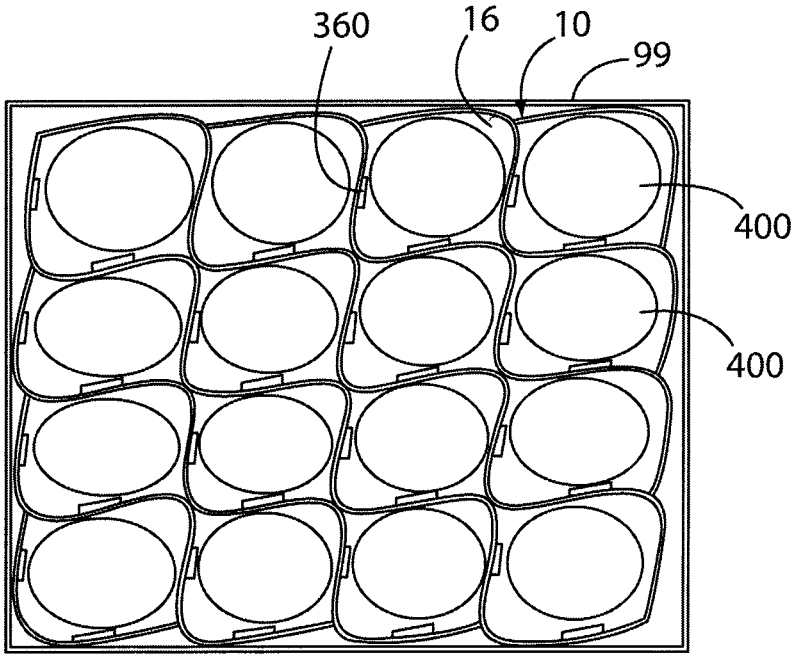

FIGS. 14A and 14B illustrate yet another embodiment of the collapsible cell assembly 10 with padding in the cells 16. FIG. 14A shows a collapsible cell assembly 10 with semi-rigid walls (e.g., corrugated board) and FIG. 14B shows a collapsible cell assembly 10 with flexible walls (e.g., fabric, paper or fluted paper). As illustrated in FIGS. 14A and 14B, the panels 14 can have a plurality of pads 360 connected thereto before or after the panels 14 are connected together (using any of the methods described above). The pads 360 can be on two, three or four walls of the cells 16 to protect the items 400 within the cells 16 from being damaged. It is contemplated that the pads 360 could be made of foam, bubble wrap, or any other padded or soft (or even hard and/or rigid material if desired). Furthermore, the pads 360 do not have to cover the entire wall, but can only cover the point of contact of the item 400 with the walls. Such padding can protect abrasive items from damaging the walls and protect fragile items in the cells. After the collapsible cell assembly 10 with the pads 360 is formed, the collapsible cell assembly 10 can be placed into a container 99, if desired.

Figures 15A, 15B, 15C, 15D, 15E:
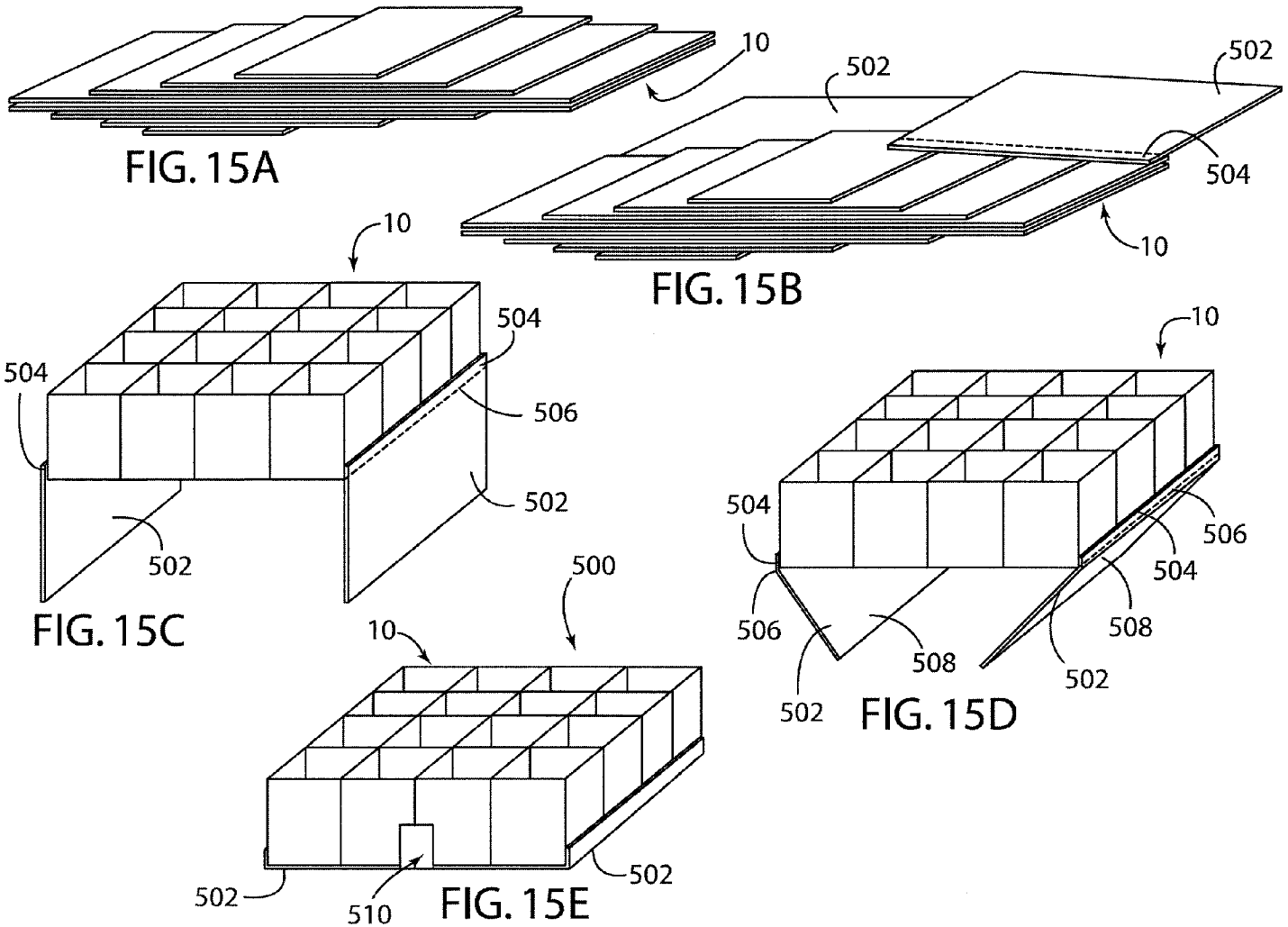
FIGS. 15A-15E illustrate a collapsible cell assembly of the present invention formed into a container.

FIGS. 15A-15E illustrate another embodiment of the collapsible cell assembly 10 with the collapsible cell assembly 10 forming a container 500 (see FIG. 15E). The container 500 is first formed by making the collapsible cell assembly 10 using any of the methods discussed above and as illustrated in FIG. 15A. Thereafter, at least one rigid panel 502 is connected to a bottom of the collapsible cell assembly 10 as illustrated in FIG. 15B. As shown in FIG. 15B, only one end 504 of the rigid panel 502 is connected to the collapsible cell assembly 10. The collapsible cell assembly 10 can then be expanded as illustrated in FIG. 15C. Thereafter, the at least one rigid panel 502 is folded about line 506 (which divides the panel 502 into the end 504 and the remainder 508 of the panel 502). Finally, as illustrated in FIG. 15E, the remainder 508 of the panels 502 are positioned to abut a bottom of the collapsible cell assembly 10. The panels 502 can be connected to each other and/or the collapsible cell assembly using tape 510 or any other connection material. It is contemplated that the panel 502 could include one panel that has two fold lines 506 and two ends 504, with each end 504 being connected to opposite sides of the collapsible cell assembly 10. Such a collapsible cell assembly 10 with the at least one panel 502 does not need a container 99.

Figure 16A:
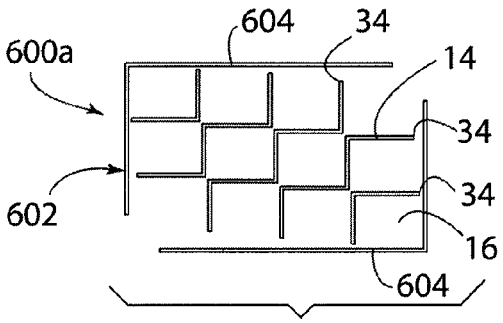
FIGS. 16A-16D illustrate yet another method of forming a collapsible cell assembly of the present invention into a container.
Figure 16B:
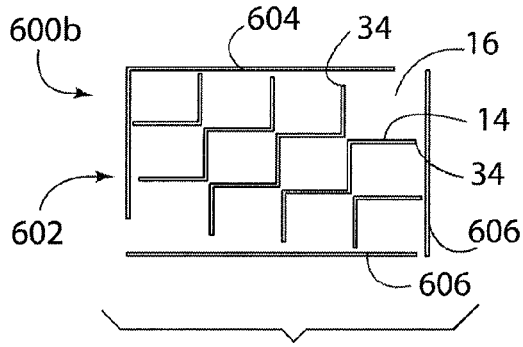
Figure 16C:
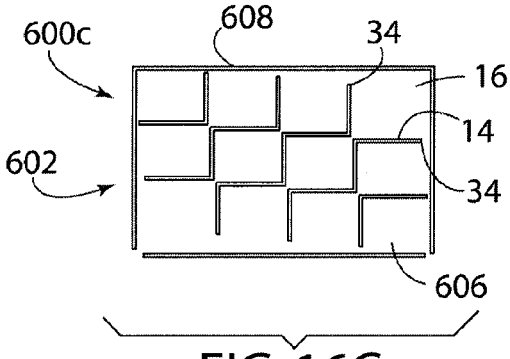
Figure 16D:
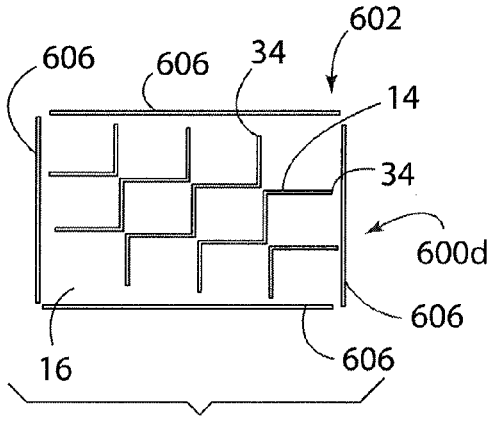

FIGS. 16A-16D illustrate another embodiment of the collapsible cell assembly 10 with the collapsible cell assembly 10 forming a container 600*a*-600*d*, respectively. In FIGS. 16A-16D, the panels 14 of the collapsible cell assembly 10 are placed in an opposite position as to that described above such that the ends 34 of each of the panels 14 are free and the outside of the panels 14 do not form cells 16 with four walls, but with only two or three walls (with the outside wall being absent). However, the outside walls of the cells 16 are formed by outside solid support walls. Therefore, the containers 600*a*-600*d* are first formed by making the collapsible cell assembly 10 using any of the methods discussed above. Thereafter, at least one rigid panel 602 is connected to the ends 34 of the panels 14. Therefore, the container could have a rectangular wall attached to the ends 34 of the panels 14 (not shown), the container 600*a* could have two L-shaped walls 604 attached to the ends 34 of the panels 14 (FIG. 16A), the container 600*b* could have one L-shaped wall 604 and two straight walls 606 attached to the ends 34 of the panels 14 (FIG. 16B), the container 600*c* could have one U-shaped wall 608 and one straight wall 606 attached to the ends 34 of the panels 14 (FIG. 16C), or the container 600*d* could have four straight walls 606 attached to the ends 34 of the panels 14 (FIG. 16A). A flat sheet (not shown) can thereafter be attached to a bottom of the panels 14. Such collapsible cell assemblies 10 as shown in FIGS. 16A-16D do not need a container 99 (although they can be placed in a container 99).

FIG. 17 illustrates a first embodiment of a second collapsible cell assembly 1000 of the present invention in an expanded configuration. The first embodiment of the second collapsible cell assembly 1000 comprises a plurality of full length panels 1002 forming a plurality of full length side walls and a plurality of partial length panels 1004 forming a plurality of partial length side walls. Each of the partial length panels 1004 has a first folded end 1006 and a second folded end 1008, with the first folded end 1006 being bent in a direction opposite to the second folded end 1008. Each of the first folded end 1006 and the second folded end 1008 are attached to one of the full length panels 1002 (e.g., a pair of adjacent full length panels 1002), thereby forming a plurality of cells 1016, with each cell 1016 being formed by a pair of parallel full length panels 1002 and a pair of parallel partial length panels 1004.

FIG. 18 is a side view of the second collapsible cell assembly of the present invention in a fully collapsed configuration (wherein distances are exaggerated for illustration). FIG. 18 also illustrates a method of forming the first embodiment of the second collapsible cell assembly 1000 of the present invention. During assembly of the first embodiment of the second collapsible cell assembly 1000, a bottom full length panel 1002 is placed on a support surface. A second row of partial length panels 1004 is then attached to the bottom full length panel 1002. For example, an adhesive can be at points 1010 where the first folded end 1006 of each partial length panel 1004 join the bottom full length panel 1002 (either on the bottom full length panel or on the first folded end 1006). Thereafter, a second full length panel 1002 is positioned on top of and attached to the second row of partial length panels 1004. For example, an adhesive can be at points 1012 where the second folded end 1008 of each partial length panel 1004 join the second full length panel 1002 (either on the second full length panel or on the second folded end 1008). This process is continued using alternative rows of full length panels 1002 and partial length panels 1004 until the first embodiment of the second collapsible cell assembly 1000 is complete. The first embodiment of the second collapsible cell assembly 1000 can then be expanded by pulling the top and bottom full length panels 1002 away from each other, thereby forming a box shape with a plurality of rectangular cells 1016.

The collapsible cell assembly 1000 can have panels made of any material (e.g., the material of the first collapsible cell assembly 10 discussed above) and can have any number of cells in any matrix. It is further contemplated that the cells 1016 could be square or rectangular. It is also contemplated that the cells could be of different size (e.g., by having differing numbers of partial length panels 1004 in one row (see FIG. 21). The collapsible cell assembly 1000 can also be constructed and/or use any of the features of the first collapsible cell assembly 10 described above in regard to FIGS. 5-16D.

FIG. 19 is a top view of two examples of a second embodiment of a second collapsible cell assembly 1000*a* of the present invention in an expanded configuration. FIG. 20 is a side view of the second embodiment of the second collapsible cell assembly 1000*a* of the present invention in a collapsed configuration. The second embodiment of a second collapsible cell assembly 1000*a* is identical to the first embodiment of a second collapsible cell assembly 1000*a*, except that the partial length panels 1004 at ends of the second embodiment of the second collapsible cell assembly 1000*a* are absent. The second embodiment of the second collapsible cell assembly 1000*a* is configured to be placed in a container as discussed above. It is noted that the top collapsible cell assembly 1000*a* of FIG. 19 includes partial length panels 1004 that are all folded the same way (e.g., left side up and right side down for each partial length panel 1004) and the bottom collapsible cell assembly 1000*a* of FIG. 19 includes partial length panels 1004 that have an opposite orientation per row (e.g., left side up and right side down for each partial length panel 1004 in one vertical row and right side up and left side down for each partial length panel 1004 in an adjacent vertical row).

Both the first embodiment of the collapsible cell assembly as disclosed in FIGS. 1-16 and the second embodiment of the collapsible cell assembly as disclosed in FIGS. 17-20 (along with every other example of the collapsible cell assembly) can be formed by placing panels on a flat surface without the requirement for folding any of the panels over on top of itself (such that one surface is touching another surface), thereby easing the method of making the collapsible cell assemblies.

Figure 23A:
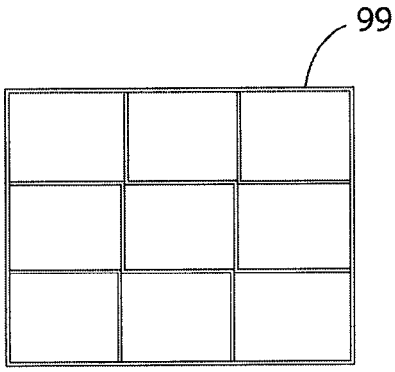
FIGS. 23A-D illustrate the collapsible cell assembly of the present invention as it folds or collapses in a parallelogram motion.
Figure 23B:
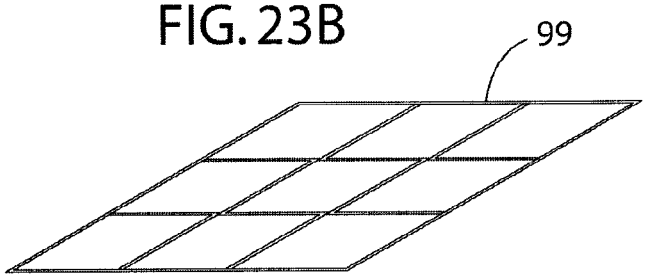
Figure 23C:
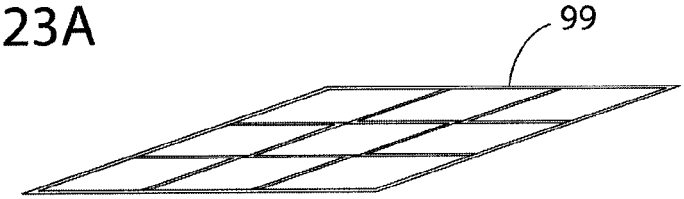
Figure 23D:
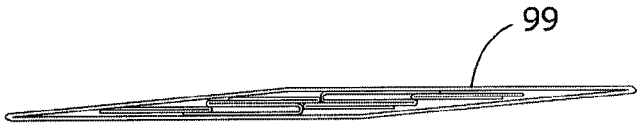

FIGS. 23A-23D illustrate the collapsible cell assembly in various stages of collapsing. The collapsible cell assembly of FIGS. 23A-23D includes a folding container 99 having four walls, with the four walls being pivotable relative to each other to allow the folding container 99 to collapse in a parallelogram motion. The inside cellular structure is connected to the four walls (or at least two of them). The cellular structure comprising a plurality of interconnected panels forming a plurality of cells, with the panels being formed of soft, deformable material (e.g., bubble wrap, fabric, paper material and films (e.g., plastic films)). The folding container 99 can be folded with the inside cellular structure therein such that the collapsible container assembly will be substantially flat when the folding container is moved to a collapsed position as illustrated in FIG. 23D. It is noted that the panels do not have to be creased before connection to the container 99.

Figure 24:
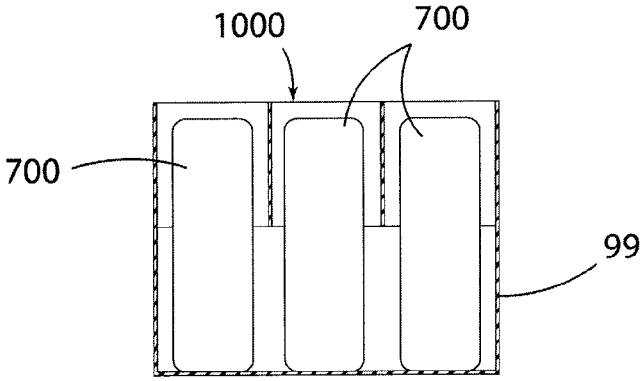
FIG. 24 illustrates another embodiment of the collapsible cell assembly having half size panels.

FIG. 24 illustrates a collapsible cell assembly 1000 with the panels being spaced from a bottom of the bottom wall of the container 99. The collapsible cell assembly 1000 is connected to the walls of the container 99 in this illustration and therefore the structure of the container 99 maintains the cells in an open position to keeps a product 700 within the cells. The panels are spaced from the bottom wall of the container 99 to use less material for the support structure for the products 700.

In the illustrated examples, the panels can have additional lengths to accommodate the connection area of the panels to each other and/or to the container. For example, if the attachment point is 0.125 inches, each panel can have 0.125 times the number of attachment points for that panel added to its overall length. Therefore, the collapsible cell assemblies will be able to easily fold flat and to maintain their substantially rectangular structure when opened. Flexible or soft material for the panels can also assist in enabling the collapsible cell assemblies to easily fold flat and maintaining their substantially rectangular structure when opened.

Accordingly, the present application allows construction of a collapsible cell assembly made of soft panels that can be removably positioned into a collapsible container or box and collapse with the container or box to be substantially flat. As used herein, soft means having the ability to bend or fold without the need of a crease or score to allow the panels to bend and wherein the panels can return to their original shape after bending without a permanent crease or fold in the panels after bending. Furthermore, the panels can be connected along their entire height and the panels can be connected to the collapsible container or box spaced from the floor of the container or box.

The foregoing detailed description is considered that of a preferred embodiment only, and the particular shape and nature of at least some of the components in this embodiment are at least partially based on manufacturing advantages and considerations as well as on those pertaining to assembly and operation. Modifications of this embodiment may well occur to those skilled in the art and to those who make or use the invention after learning the nature of this preferred embodiment, and the invention lends itself advantageously to such modification and alternative embodiments. For example, while the sealing machine 100 is illustrated for use in the method of FIG. 5, other sealing machines could be used. Moreover, it is contemplated that, for panels being made of multiple materials as discussed above, that the multiple materials could be connected during the step of connecting two adjacent panels together (e.g., the step of welding two adjacent panels together could also connect the two materials of one of the panels together). Additionally, it is contemplated that the panels can be connected together starting from the panels of the middle of the collapsible cell assembly 10 (i.e., any of the panels below the top panel and above the middle panel) and working to the top or bottom of the stack of panels and then working the other way (i.e., to the bottom or top of the stack of panels, respectively). Moreover, it is contemplated that only the top panel 26 and the bottom panel 24 could have their ends connected to the adjacent panels 14, with the remaining panels 14 between the top panel 26 and the bottom panel 24 only being connected to walls of the container 99 as the walls of the container 99 will maintain the shape of the cells 16 even without the panels 14 between the top panel 26 and the bottom panel 24 being connected together. Additionally, it is contemplated that only the top panel 26 and the bottom panel 24 be connected to the container 99 (e.g., a stationary box, four walls that can be folded relative to each other and then placed in a stationary box or four walls of a typical cardboard box) (e.g., at or adjacent a corner between two opposite walls of the container). Therefore, it is to be understood that the embodiment shown in the drawings and described above is provided principally for illustrative purposes and should not be used to limit the scope of the invention. Furthermore, it is to be understood that such concepts are intended to be covered by the following claims unless these claims by their language expressly state otherwise.

We claim:

1. A collapsible container assembly comprising:

a folding container having at least two walls pivotable relative to each other at a corresponding corner disposed between the at least two walls; and an inside cellular structure attached to at least a portion of the at least two walls with a mechanical fastener, adjacent the corner, the cellular structure comprising a plurality of interconnected panels forming a plurality of cells, each cell having four cell walls, with each cell wall having a thickness of a single panel, the cellular structure further comprising a plurality of cells in both an X and Y direction with respect to the cellular structure;

wherein the folding container can be folded to a collapsed position in a parallelogram motion with the inside cellular structure therein such that the panels are superimposed and do not intersect one another and wherein the collapsible container assembly will be substantially flat when the folding container is moved to the collapsed position.

2. The collapsible container assembly of claim 1, wherein the panels are formed of bubble wrap.

3. The collapsible container assembly of claim 1, wherein the folding container comprises corrugated material.

4. The collapsible container assembly of claim 1, wherein the panels are adhered together.

5. The collapsible container assembly of claim 1, wherein the panels are welded together.

6. The collapsible container assembly of claim 1, wherein the cells all have a cross-sectional shape that is substantially the same.

7. The collapsible container assembly of claim 1, wherein at least two of the cells all have a different cross-sectional shape.

8. The collapsible container assembly of claim 1, wherein the panels are formed of soft, deformable material.

9. The collapsible container assembly of claim 1, wherein the container further includes a bottom wall.

10. The collapsible container assembly of claim 9, wherein the panels are spaced from the bottom wall.

11. The collapsible container assembly of claim 1, wherein the panels are formed of fabric.

12. The collapsible container assembly of claim 11, wherein the fabric is woven.

13. The collapsible container assembly of claim 11, wherein the fabric is non-woven.

14. The collapsible container of claim 1, wherein the mechanical fastener that attaches the inside cellular structure to the at least a portion of the at least two walls, comprises at least one of a glue, at least one staple, or a hook and loop mechanism.

* * * * *